US011571080B2

(12) United States Patent
Moss et al.

(10) Patent No.: US 11,571,080 B2
(45) Date of Patent: Feb. 7, 2023

(54) DUAL-MOUNTED END CAP SYSTEM AND LOCKING SYSTEM FOR AN ADJUSTABLE ROD

(71) Applicant: House of Atlas, LLC, Evanston, IL (US)

(72) Inventors: Jason Moss, Libertyville, IL (US); Matthew Berman, Chicago, IL (US); Alan Arthur Ford, Sturgis, MI (US)

(73) Assignee: House of Atlas, LLC, Evanston, IL (US)

( * ) Notice: Subject to any disclaimer, the term of this patent is extended or adjusted under 35 U.S.C. 154(b) by 0 days.

(21) Appl. No.: 17/187,407

(22) Filed: Feb. 26, 2021

(65) Prior Publication Data

US 2021/0177183 A1 Jun. 17, 2021

Related U.S. Application Data

(63) Continuation of application No. 16/297,357, filed on Mar. 8, 2019, now Pat. No. 10,959,559.

(51) Int. Cl.

| | |
|---|---|
| ***A47H 1/022*** | (2006.01) |
| ***A47H 1/102*** | (2006.01) |
| *A47K 3/38* | (2006.01) |

(52) U.S. Cl.

CPC ..... *A47H 1/022* (2013.01); *A47H 1/102* (2013.01); *A47K 3/38* (2013.01)

(58) Field of Classification Search

CPC ..... A47H 1/022; A47H 1/102; A47H 2001/0215; F16B 7/1463; F16B 33/006; A47K 3/38

See application file for complete search history.

(56) References Cited

U.S. PATENT DOCUMENTS

| | | | |
|---|---|---|---|
| 424,610 | A | 4/1890 | Laurence |
| 453,631 | A | 6/1891 | Farley |
| 666,467 | A | 1/1901 | Clark |
| 938,883 | A | 11/1909 | Maier |
| 961,352 | A | 6/1910 | Walters |

(Continued)

FOREIGN PATENT DOCUMENTS

| | | |
|---|---|---|
| CH | 625601 | 9/1981 |
| DE | 327136 | 10/1920 |

(Continued)

OTHER PUBLICATIONS

Artika Shower Caddy—Odyssey 2 Instruction Manual (PO-22046), Publicly available for purchase before May 18, 2020, 5 pages.

(Continued)

*Primary Examiner* — Stanton L Krycinski

(74) *Attorney, Agent, or Firm* — Fitch Even Tabin & Flannery LLP

(57) ABSTRACT

There is provided a dual mount end cap system for mounting a rod. The dual mount end cap system includes both a threaded system and a fastener system. This enables end caps of the system to be pre-mounted using a fastener and also adjusted using the threaded system. The fastener can extend through the dual mount end cap system. Alternatively, the threaded system can be used without the fastener system. There also is provided a stop system to prevent a locking system for an adjustable rod system to prevent the locking system from becoming stuck.

10 Claims, 30 Drawing Sheets

(56) References Cited

U.S. PATENT DOCUMENTS 1,062,478 A 5/1913 Kroder
1,374,026 A 4/1921 Nelson
1,401,727 A 12/1921 Pimlott
1,679,881 A 10/1925 Simpson
1,639,551 A 8/1927 Booth
1,742,164 A 12/1929 Berke
1,756,716 A 4/1930 Whitney
1,837,340 A 12/1931 Schwartz
1,910,555 A 5/1933 Marlowe
1,951,660 A 3/1934 Klaudt
2,032,842 A 3/1936 Gould
2,199,851 A * 5/1940 John ..... A47H 1/102
248/265
2,275,330 A 3/1942 Tveten
2,293,168 A 8/1942 Amato
2,355,489 A 8/1944 Waddell
2,490,369 A 12/1949 Neuwirth
2,508,039 A 5/1950 Neuwirth
2,637,555 A 5/1953 Klaudt
2,643,143 A 6/1953 Bergqvist
2,661,850 A 12/1953 Fowler et al.
2,695,800 A 11/1954 Soucy
2,840,402 A 6/1958 Hassel
2,903,141 A 9/1959 Seewack
2,947,556 A 8/1960 Wenger
2,974,806 A 3/1961 Seewack
2,999,706 A 9/1961 Wilcox
3,004,743 A 10/1961 Wenger
3,040,902 A 6/1962 Dunn
3,098,669 A 7/1963 Fortin
3,227,113 A 1/1966 Kupski
3,424,111 A 1/1969 Maslow
3,559,352 A 2/1971 Magnuson
3,560,032 A 2/1971 Cohen et al.
3,572,511 A 3/1971 Triplett
3,674,294 A 7/1972 Kirkham
3,809,142 A 5/1974 Bleeker
3,851,601 A 12/1974 Davis
4,024,686 A 5/1977 Gronert
4,128,064 A 12/1978 Chung
4,134,703 A 1/1979 Hinners
4,248,418 A 2/1981 Friedberg
4,390,099 A 6/1983 Trautlein
4,405,111 A 9/1983 Lennon
4,419,026 A 12/1983 Leto
4,422,794 A 12/1983 Deken
4,506,477 A 3/1985 Castle
4,629,207 A 12/1986 Shiflet
4,653,714 A 3/1987 Andrasko, Jr.
4,700,918 A 10/1987 Andrasko, Jr.
4,765,001 A 8/1988 Smith
4,856,929 A 8/1989 Smahlik
4,895,471 A 1/1990 Geltz
5,022,104 A 6/1991 Miller
5,054,624 A 10/1991 Camp
D324,328 S 3/1992 Pagan
D327,421 S 6/1992 Pagan
5,156,281 A 10/1992 Schwartz
5,242,065 A 9/1993 Hoban
5,259,520 A 11/1993 Roggio
5,303,832 A 4/1994 Tu
5,317,855 A 6/1994 De Leeuw
5,330,061 A 7/1994 Geltz
5,333,665 A 8/1994 Safar
5,433,551 A 7/1995 Gordon
5,549,407 A 8/1996 Levi
5,615,721 A 4/1997 Winter
5,653,057 A 8/1997 Gary
5,678,703 A 10/1997 Sawyer
5,702,010 A 12/1997 Liang
D398,468 S 9/1998 Yemini
5,803,643 A 9/1998 Patelli
5,826,847 A 10/1998 Warner
5,881,653 A 3/1999 Pfister
5,894,610 A 4/1999 Winter
5,964,444 A 10/1999 Guertler
5,996,674 A 12/1999 Gatewood
5,996,791 A 12/1999 Bibby
D421,692 S 3/2000 Wojtowicz
6,062,149 A 5/2000 Duvivier
D429,934 S 8/2000 Hofman
6,213,437 B1 4/2001 Robbins
D443,162 S 6/2001 Winter
D443,813 S 6/2001 Harwanko
6,250,839 B1 6/2001 Lenhart
6,286,282 B1 9/2001 Castano
D450,947 S 11/2001 Walker
D456,167 S 4/2002 Harwanko
6,443,207 B1 9/2002 Cheng
D466,798 S 12/2002 Rebman
D466,799 S 12/2002 Suero, Jr.
D470,332 S 2/2003 Clucas
6,520,351 B1 2/2003 Zadro
D472,453 S 4/2003 Rebman
6,543,629 B1 4/2003 Samelson
D475,551 S 6/2003 Kelso
D475,561 S 6/2003 Suero, Jr.
D475,562 S 6/2003 Suero, Jr.
6,575,316 B2 6/2003 Lin
6,581,790 B1 6/2003 Zadro
6,637,364 B1 10/2003 Campeau
6,640,867 B1 11/2003 Pallotta
6,651,831 B2 11/2003 Samelson
D483,251 S 12/2003 Suero, Jr.
6,681,831 B1 1/2004 Cheng
D491,448 S 6/2004 Rebman
6,761,202 B1 7/2004 Cheng
D494,052 S 8/2004 Winter
D494,455 S 8/2004 Winter
D494,845 S 8/2004 Winter
6,823,925 B2 11/2004 Militello
6,824,000 B2 11/2004 Samelson
D499,329 S 12/2004 Suero, Jr.
D500,670 S 1/2005 Rebman
6,845,955 B1 1/2005 Hsu
D501,737 S 2/2005 Clucas
D501,738 S 2/2005 Clucas
6,862,776 B2 3/2005 Chen
6,865,817 B2 3/2005 Militello
D504,310 S 4/2005 Harwanko
D504,807 S 5/2005 Harwanko
D505,062 S 5/2005 Suero, Jr.
D505,317 S 5/2005 Harwanko
D507,129 S 7/2005 Harwanko
6,948,545 B1 9/2005 Cheng
6,959,752 B2 11/2005 Huang
6,962,186 B2 11/2005 Hsu
6,966,353 B2 11/2005 Hsu
D513,142 S 12/2005 Suero, Jr.
D513,373 S 1/2006 Harwanko
6,994,143 B2 2/2006 McCarty
7,000,521 B1 2/2006 Cheng
7,000,787 B2 2/2006 Felsenthal
D516,902 S 3/2006 Harwanko
D522,844 S 6/2006 Harwanko
D522,845 S 6/2006 Suero, Jr.
D522,846 S 6/2006 Suero, Jr.
D522,847 S 6/2006 Suero, Jr.
D525,115 S 7/2006 Harwanko
D525,813 S 8/2006 Beasley
D526,520 S 8/2006 Clucas
D527,246 S 8/2006 Clucas
7,128,124 B2 10/2006 Bibby
D534,793 S 1/2007 Suero, Jr.
D538,571 S 3/2007 Militello
D539,064 S 3/2007 Militello
7,194,811 B2 3/2007 Militello
7,195,051 B2 3/2007 Nien
D542,897 S 5/2007 Harwanko
D543,747 S 6/2007 Harwanko
D543,748 S 6/2007 Harwanko
D544,786 S 6/2007 Barrese
D545,180 S 6/2007 Harwanko
7,225,850 B2 6/2007 McCarty

(56) References Cited

U.S. PATENT DOCUMENTS

| | | | |
|---|---|---|---|
| D547,165 | S | 7/2007 | Barrese |
| D547,166 | S | 7/2007 | Barrese |
| D547,167 | S | 7/2007 | Barrese |
| D548,574 | S | 8/2007 | Harwanko |
| 7,255,149 | B2 | 8/2007 | Rossato |
| 7,264,035 | B2 | 9/2007 | Rossato |
| D562,608 | S | 2/2008 | Kramer |
| D562,609 | S | 2/2008 | Kramer |
| 7,331,370 | B1 | 2/2008 | Militello |
| D563,136 | S | 3/2008 | Kramer |
| D563,138 | S | 3/2008 | Kramer |
| 7,341,230 | B2 | 3/2008 | Beaudry |
| 7,346,940 | B1 | 3/2008 | Liao |
| D566,991 | S | 4/2008 | Harwanko |
| D568,656 | S | 5/2008 | Kramer |
| D569,149 | S | 5/2008 | Walker |
| D569,668 | S | 5/2008 | Kramer |
| D571,136 | S | 6/2008 | Kramer |
| D573,386 | S | 7/2008 | Clucas |
| D573,387 | S | 7/2008 | Walker |
| D576,475 | S | 9/2008 | Didehvar |
| D576,476 | S | 9/2008 | Didehvar |
| D586,647 | S | 2/2009 | Didehvar |
| D591,142 | S | 4/2009 | Cittadino |
| 7,549,615 | B2 | 6/2009 | Shevick |
| 7,562,689 | B1 | 7/2009 | Militello |
| 7,600,549 | B2 | 10/2009 | Cheng |
| 7,641,161 | B2 | 1/2010 | Bauer |
| 7,658,154 | B2 | 2/2010 | Yankello |
| 7,665,500 | B2 | 2/2010 | Rossato |
| 7,726,898 | B2 | 6/2010 | Lenhart |
| 7,819,166 | B2 | 10/2010 | Militello |
| D628,000 | S | 11/2010 | Lindo |
| 7,857,151 | B2 | 12/2010 | Barrese |
| D632,513 | S | 2/2011 | Cittadino |
| D632,514 | S | 2/2011 | Didehvar |
| D632,515 | S | 2/2011 | Cittadino |
| 7,877,824 | B2 | 2/2011 | Grant |
| D633,780 | S | 3/2011 | Barrese |
| D635,807 | S | 4/2011 | Lindo |
| 7,926,127 | B2 | 4/2011 | Barrese |
| 7,931,160 | B2 | 4/2011 | Newbouild |
| D640,488 | S | 6/2011 | Didehvar |
| D641,190 | S | 7/2011 | Cittadino |
| D641,191 | S | 7/2011 | Walker |
| D641,193 | S | 7/2011 | Vaccaro |
| D641,194 | S | 7/2011 | Vaccaro |
| 7,984,814 | B2 | 7/2011 | Didehvar |
| D643,236 | S | 8/2011 | Cittadino |
| D643,657 | S | 8/2011 | Cittadino |
| D644,050 | S | 8/2011 | Cittadino |
| D647,391 | S | 10/2011 | Barrese |
| D648,969 | S | 11/2011 | Cittadino |
| D649,352 | S | 11/2011 | Cittadino |
| 8,056,873 | B1 | 11/2011 | Hanely |
| D650,263 | S | 12/2011 | Barrese |
| 8,069,507 | B2 | 12/2011 | Didehvar |
| 8,069,632 | B2 | 12/2011 | Li |
| 8,069,999 | B2 | 12/2011 | Didehvar |
| D652,236 | S | 1/2012 | Walker |
| D652,237 | S | 1/2012 | Cittadino |
| D653,067 | S | 1/2012 | Cittadino |
| 8,113,361 | B2 | 2/2012 | Winter |
| 8,157,111 | B2 | 4/2012 | Didehvar |
| D660,064 | S | 5/2012 | Webb |
| D660,065 | S | 5/2012 | Webb |
| D660,066 | S | 5/2012 | Webb |
| 8,166,583 | B1 | 5/2012 | Liang |
| 8,185,981 | B2 | 5/2012 | Didehvar |
| D661,529 | S | 6/2012 | Cittadino |
| D661,927 | S | 6/2012 | Cittadino |
| D664,423 | S | 7/2012 | Cittadino |
| D664,424 | S | 7/2012 | Cittadino |
| 8,214,938 | B2 | 7/2012 | Hanley |
| 8,215,501 | B2 | 7/2012 | Trettin |
| 8,215,863 | B2 | 7/2012 | Sohn |
| 8,225,946 | B2 | 7/2012 | Yang |
| D666,012 | S | 8/2012 | Walker |
| D667,246 | S | 9/2012 | Cittadino |
| D667,295 | S | 9/2012 | Harwanko |
| 8,297,870 | B2 | 10/2012 | Lenhart |
| D670,521 | S | 11/2012 | Cittadino |
| D670,522 | S | 11/2012 | Cittadino |
| D670,944 | S | 11/2012 | Cittadino |
| D671,347 | S | 11/2012 | Cittadino |
| D671,348 | S | 11/2012 | Cittadino |
| D671,395 | S | 11/2012 | Harwanko |
| D672,178 | S | 12/2012 | Walker |
| D672,990 | S | 12/2012 | Lindo |
| D672,991 | S | 12/2012 | Cittadino |
| 8,341,775 | B2 | 1/2013 | Didehvar |
| 8,347,936 | B2 | 1/2013 | Martin |
| 8,348,072 | B2 | 1/2013 | Whitehall |
| 8,408,405 | B2 | 4/2013 | Yang |
| D681,422 | S | 5/2013 | Lindo |
| D681,423 | S | 5/2013 | Walker |
| D684,037 | S | 6/2013 | Harwanko |
| 8,479,932 | B2 | 7/2013 | Carney |
| 8,491,568 | B2 | 7/2013 | Schertiger |
| 8,500,357 | B2 | 8/2013 | Stahle |
| 8,505,129 | B2 | 8/2013 | Parker |
| D691,029 | S | 10/2013 | Didehvar |
| D691,030 | S | 10/2013 | Lindo |
| D691,031 | S | 10/2013 | Harwanko |
| 8,561,667 | B1 | 10/2013 | Hanley |
| D693,209 | S | 11/2013 | Walker |
| 8,573,416 | B2 | 11/2013 | Didehvar |
| 8,578,995 | B2 | 11/2013 | Nelson |
| D696,573 | S | 12/2013 | Didehvar |
| 8,616,138 | B1 | 12/2013 | Fu |
| D702,112 | S | 4/2014 | Cittadino |
| 8,696,229 | B2 | 4/2014 | Tran |
| 8,763,821 | B2 | 7/2014 | Yang |
| 8,763,822 | B2 | 7/2014 | Didehvar |
| 8,807,513 | B2 | 8/2014 | Volin |
| 8,814,114 | B2 | 8/2014 | Baines |
| 8,827,587 | B2 | 9/2014 | Didehvar |
| 8,839,980 | B2 | 9/2014 | Baines |
| D714,571 | S | 10/2014 | Walker |
| 8,851,305 | B2 | 10/2014 | Didehvar |
| 8,851,435 | B1 | 10/2014 | Bastien |
| 8,869,999 | B2 | 10/2014 | Lindo |
| 8,875,770 | B1 | 11/2014 | Martin |
| 8,960,456 | B2 | 2/2015 | Didehvar |
| 8,978,228 | B2 | 3/2015 | Didehvar |
| 9,009,878 | B2 | 4/2015 | Baines |
| 9,021,627 | B2 | 5/2015 | Parker |
| 9,033,163 | B2 | 5/2015 | Hsu |
| 9,066,637 | B2 | 6/2015 | Zeng |
| 9,107,495 | B2 | 8/2015 | Lindo |
| 9,107,496 | B2 | 8/2015 | Lindo |
| 9,107,529 | B2 | 8/2015 | Didehvar |
| 9,107,544 | B2 | 8/2015 | Cittadino |
| 9,131,795 | B2 | 9/2015 | Didehvar |
| 9,161,664 | B2 | 10/2015 | Zeng |
| 9,194,415 | B2 | 11/2015 | Ou |
| 9,204,764 | B1 | 12/2015 | Hanley |
| D746,667 | S | 1/2016 | Vaccaro |
| 9,271,592 | B2 | 3/2016 | Didehvar |
| 9,339,151 | B2 | 5/2016 | Yang |
| 9,357,860 | B1 | 6/2016 | Klowan |
| 9,388,837 | B1 | 7/2016 | Hanley |
| 9,468,294 | B2 | 10/2016 | Fu |
| 9,474,421 | B2 | 10/2016 | Baines |
| 9,480,314 | B2 | 11/2016 | Heim |
| 9,578,995 | B2 | 2/2017 | Hanley |
| 9,693,660 | B1 | 7/2017 | Stelmarski |
| 9,770,138 | B2 | 9/2017 | Engell |
| 9,808,125 | B2 | 11/2017 | Jepson |
| 9,883,742 | B2 | 2/2018 | Yang |
| 9,943,192 | B2 | 4/2018 | Yang |
| 9,999,322 | B2 | 6/2018 | Hain |
| 10,034,587 | B1 | 7/2018 | Elliot |
| 10,047,787 | B2 | 8/2018 | Cheng |

(56) References Cited

U.S. PATENT DOCUMENTS

| | | | |
|---|---|---|---|
| 10,064,523 | B2 | 9/2018 | Engell |
| 10,070,748 | B2 | 9/2018 | Hanley |
| 10,092,126 | B2 | 10/2018 | Baines |
| 10,278,529 | B2 | 5/2019 | Baines |
| 10,426,287 | B1 | 10/2019 | Tsai |
| 10,463,199 | B2 | 11/2019 | Coratolo |
| 10,485,383 | B2 | 11/2019 | Worden, IV |
| 10,595,683 | B1 | 3/2020 | Stelmarski |
| 10,612,576 | B2 | 4/2020 | Hanley |
| 10,758,091 | B2 | 9/2020 | Engell |
| 10,786,105 | B2 | 9/2020 | Scanlon |
| 10,844,890 | B2 | 11/2020 | Daniels |
| 10,925,403 | B1 | 2/2021 | Su |
| 10,959,559 | B2 | 3/2021 | Moss |
| 11,382,447 | B2 | 7/2022 | Berman |
| 2002/0158033 | A1 | 10/2002 | Chen |
| 2003/0209509 | A1 | 11/2003 | Felsenthal |
| 2004/0182806 | A1 | 9/2004 | Figueroa |
| 2004/0228704 | A1 | 11/2004 | Rotshtain |
| 2005/0263655 | A1 | 12/2005 | Bauer |
| 2006/0156465 | A1 | 7/2006 | Lavi |
| 2006/0204322 | A1 | 9/2006 | Roiser |
| 2007/0170134 | A1 | 7/2007 | Bishop |
| 2008/0163418 | A1 | 7/2008 | Barrese |
| 2009/0184078 | A1 | 7/2009 | Lee |
| 2009/0223642 | A1 | 9/2009 | Militello |
| 2009/0223917 | A1 | 9/2009 | Grant |
| 2010/0206492 | A1 | 8/2010 | Shevick |
| 2010/0310306 | A1 | 12/2010 | Wright |
| 2010/0316438 | A1 | 12/2010 | Sohn |
| 2011/0226925 | A1 | 9/2011 | Tsai |
| 2011/0284484 | A1 | 11/2011 | Lin |
| 2011/0297632 | A1 | 12/2011 | Goldstein |
| 2012/0005823 | A1 | 1/2012 | Baines |
| 2012/0017366 | A1 | 1/2012 | Barrese |
| 2012/0103924 | A1 | 5/2012 | Chuang |
| 2012/0152872 | A1 | 6/2012 | Didehvar |
| 2012/0152873 | A1 | 6/2012 | Didehvar |
| 2012/0152874 | A1 | 6/2012 | Didehvar |
| 2012/0217215 | A1 | 8/2012 | Emery |
| 2012/0241399 | A1 | 9/2012 | Trettin |
| 2012/0284914 | A1 | 11/2012 | Bauer |
| 2012/0285914 | A1 | 11/2012 | Carney |
| 2013/0045041 | A1 | 2/2013 | Sohn |
| 2013/0112639 | A1 | 5/2013 | Baines |
| 2013/0198948 | A1 | 8/2013 | Zeng |
| 2013/0198949 | A1 | 8/2013 | Hai |
| 2013/0200024 | A1 | 8/2013 | Lindo |
| 2013/0306828 | A1 | 11/2013 | Volin |
| 2013/0334156 | A1 | 12/2013 | Baines |
| 2013/0341474 | A1 | 12/2013 | Baines |
| 2014/0124598 | A1 | 5/2014 | Vaccaro |
| 2014/0130331 | A1 | 5/2014 | Didehvar |
| 2014/0131298 | A1 | 5/2014 | Didehvar |
| 2014/0131299 | A1 | 5/2014 | Didehvar |
| 2014/0166603 | A1 | 6/2014 | Baines |
| 2014/0224754 | A1 | 8/2014 | Baines |
| 2014/0263123 | A1 | 9/2014 | Ford |
| 2014/0360959 | A1 | 12/2014 | Didehvar |
| 2014/0360960 | A1 | 12/2014 | Didehvar |
| 2015/0034581 | A1 | 2/2015 | Hsu |
| 2015/0265086 | A1 | 9/2015 | Hanley |
| 2015/0285286 | A1 | 10/2015 | Sanford |
| 2015/0297038 | A1 | 10/2015 | Vaccaro |
| 2016/0113447 | A1 | 4/2016 | Walker |
| 2016/0206126 | A1 | 7/2016 | Ford |
| 2016/0374518 | A1 | 12/2016 | Baines |
| 2017/0360261 | A1 | 12/2017 | Coratolo |
| 2018/0008101 | A1 | 1/2018 | Engell |
| 2018/0014680 | A1 | 1/2018 | Hanley |
| 2018/0020880 | A1 | 1/2018 | Patterson |
| 2018/0051739 | A1 | 2/2018 | Cheng |
| 2018/0064279 | A1 | 3/2018 | Hanley |
| 2018/0098656 | A1 | 4/2018 | Baines |
| 2018/0296018 | A1 | 10/2018 | Baines |
| 2018/0306219 | A1 | 10/2018 | Hanley |
| 2019/0082875 | A1 | 3/2019 | Scanlon |
| 2019/0099034 | A1 | 4/2019 | Hanley |
| 2021/0030187 | A1 | 2/2021 | Berman |
| 2021/0353053 | A1 | 11/2021 | Berman |
| 2022/0225762 | A1 | 7/2022 | Berman |
| 2022/0265075 | A1 | 8/2022 | Berman |

FOREIGN PATENT DOCUMENTS

| | | |
|---|---|---|
| DE | 1046998 | 12/1958 |
| DE | 3518106 | 11/1986 |
| DE | 29720821 | 2/1998 |
| DE | 29807681 | 7/1998 |
| DE | 102008036149 | 6/2010 |
| DE | 202019106467 | 12/2019 |
| EP | 0314357 | 5/1989 |
| EP | 2113674 | 11/2009 |
| FR | 382527 | 2/1908 |
| FR | 474169 | 2/1915 |
| FR | 718486 | 1/1932 |
| WO | 2016122378 | 8/2016 |

OTHER PUBLICATIONS

Artika Tension Shower Caddy with Mirror in Aluminum, <https://www.homedepot.com/p/ARTIKA-Tension-Shower-Caddy-with-Mirror-in-Aluminum-ATL58-C1/302023780>, Publicly available for purchase before May 18, 2020, 2 pages.

Better Homes & Gardens Tension Pole Shower Caddy, <https://www.walmart.com/ip/Better-Homes-Gardens-Tension-Pole-Shower-Caddy-Oil-Rubbed-Bronze/900634206>, Publicly available for purchase before May 18, 2020, 3 pages.

Better Homes & Gardens, Model 2147HBWM (Oil Rubbed Bronze) Instruction Manual, Dec. 13, 2017, 10 pages.

Glacier Bay L Style Tension Pole Shower Caddy in Bronze with 4-Shelves (1002928650), <https://www.homedepot.com/p/Glacier-Bay-L-Style-Tension-Pole-Shower-Caddy-in-Bronze-with-4-Shelves-2130HBHD/303838532?NCNI-5>, Publicly available for purchase before May 18, 2020, 3 pages.

Glacier Bay Rustproof Tension Pole Shower Caddy in Satin Chrome (1002928717), <https://www.homedepot.com/p/Glacier-Bay-Rustproof-Tension-Pole-Shower-Caddy-in-Satin-Chrome-2141ALHD/303880494>, Publicly available for purchase before May 18, 2020, 2 pages.

InterDesign 4 Tier Tension Caddy, <https://www.kohls.com/product/prd-3451054/interdesign-4-tier-tension-caddy.jsp>, Publicly available for purchase before May 18, 2020, 1 page.

Kenney Gray 4-Tier Tension Pole Shower Caddy, <https://www.biglots.com/product/gray-4-tier-tension-pole-shower-caddy/p810196875>, Publicly available for purchase before May 18, 2020, 2 pages.

Kenney Instruction Manual, Kenney Manufacturing Company, Publicly available for purchase before May 18, 2020, 4 pages.

Made by Design (Target) Pole Caddy Instruction Manual, Style #91830 (Aluminum), 2019, 17 pages.

Made by Design L-Shaped Tension Pole Caddy Chrome, <https://www.target.com/p/steel-l-shaped-tension-pole-caddy-chrome-made-by-design-8482/-/A-54154453#lnk=sametab>, Publicly available for purchase before May 18, 2020, 3 pages.

Made by Design Rustproof Aluminum Tension Pole Caddy Chrome, <https://www.target.com/p/rustproof-aluminum-tension-pole-caddy-chrome-made-by-design-8482/-/A-54154994#lnk=sametab>, Publicly available for purchase before May 18, 2020, 3 pages.

Made by Design Steel Corner Pole Caddy, <https://www.target.com/p/steel-corner-pole-caddy-made-by-design-153/-/A-54513380?preselect=54149567#lnk=sametab>, Publicly available for purchase before May 18, 2020, 3 pages.

Mainstays Tension Pole Shower Caddy, <https://www.walmart.com/ip/Mainstays-Tension-Pole-Shower-Caddy-Chrome/700323962>, Publicly available for purchase before May 18, 2020, 2 pages.

Mainstays, 3-Tier Tension Pole Shower Caddy, <https://www.walmart.com/ip/Mainstays-3-Tier-Tension-Pole-Shower-Caddy-Satin-Nickel/634266997>, Publicly available for purchase before May 18, 2020, 3 pages.

(56) References Cited

OTHER PUBLICATIONS

ORG 3-Tier Pole Caddy, <https://www.bedbathandbeyond.com/store/product/org-3-tier-pole-caddy/3317048?keyword=org-shower-caddy>, Publicly available for purchase before May 18, 2020, 2 pages.
OXO 4-Tier Anodized Aluminum Tension Pole Shower Caddy, <https://www.bedbathandbeyond.com/store/product/oxo-4-tier-anodized-aluminum-tension-pole-shower-caddy/5193005>, Publicly available for purchase before May 18, 2020, 2 pages.
OXO Good Grips Quick-Extend Aluminum Pole Caddy (13241500) Instruction Manual, Oxo Good Grips, Publicly available for purchase before May 18, 2020, 2 pages.
Photographs of end cap by Zenith Products Corporation, publicly available before Mar. 8, 2019 (5 pages).
Pictures of Better Homes & Gardens, Smart Rods Ball Adjustable Drapery Rod, Oil-Rubbed Bronze Finish and Instructions (with English translation), known to be publicly available before Mar. 15, 2018 but not before Sep. 16, 2015, 18 pages.
Product 1—Pictures of an Adjustable Rod, publicly available before Mar. 8, 2019, 1 page.
Product 2—Pictures of an Adjustable Rod, publicly available before Mar. 8, 2019, 1 page.
Product 3—Pictures of an Adjustable Rod, publicly available before Mar. 8, 2019, 1 page.
Product 4—Pictures of an Adjustable Rod, publicly available before Mar. 8, 2019, 2 pages.
Product 5—Pictures of an Adjustable Rod, publicly available before Mar. 8, 2019, 1 page.
Product 6—Pictures of an Adjustable Rod, publicly available before Mar. 8, 2019, 1 page.
Product 7—Pictures of an Adjustable Rod, publicly available before Mar. 8, 2019, 2 pages.
SALT Steel 3-Tier Pole Shower Caddy in Sterling, <https://www.bedbathandbeyond.com/store/product/salt-steel-3-tier-pole-shower-caddy-in-sterling/5023377?keyword=salt-shower-caddy>, Publicly available for purchase before May 18, 2020, 2 pages.
SimpleHuman Stainless Steel Tension Pole Shower Caddy, <https://www.containerstore.com/s/bath/shower-bathtub/simplehuman-stainless-steel-tension-pole-shower-caddy/12d?productId=10028454&gclid=CjwKCAiAgc-ABhA7EiwAjev-j2IPg4hrYI4NADnrmdkklYKinu_0IYYHUbHezs4dVsjeVL2-kaSQSBoCjdcQAvD_BwE>, Publicly available for purchase before May 18, 2020, 1 pages.
Titan Never Rust Premium Aluminum Tension Caddy in Satin Chrome, <https://www.bedbathandbeyond.com/store/product/titan-reg-never-rust-reg-premium-aluminum-tension-caddy-in-satin-chrome/5049773> Publicly available for purchase before May 18, 2020, 2 pages.
U.S. Appl. No. 16/877,084, entitled "Customizable Shower Caddy," filed Jun. 11, 2020.
Zenna Home Corner Pole Caddy Nickel, <https://www.target.com/p/corner-pole-caddy-nickel-zenna-home/-/A-79196668#lnk=sametab>, Publicly available for purchase before May 18, 2020, 5 pages.
Zenna Home L-Shaped Pole Caddy Nickel, <https://www.target.com/p/l-shaped-pole-caddy-nickel-zenna-home/-/A-79196669#lnk=sametab>, Publicly available for purchase before May 18, 2020, 2 pages.
Zenna Model 2149PC (Chrome) Instruction Manual, Zenith Products, Dec. 6, 2017, 10 pages.

* cited by examiner

DUAL-MOUNTED END CAP SYSTEM AND LOCKING SYSTEM FOR AN ADJUSTABLE ROD

CROSS-REFERENCE TO RELATED APPLICATION

This application is a continuation of and claims priority to U.S. application Ser. No. 16/297,357, filed Mar. 8, 2019, which is hereby incorporated herein by reference in its entirety.

FIELD

The present invention relates generally to an adjustable rod and, more particularly, to endcaps for an adjustable rod and a non-jamming locking system.

BACKGROUND

Adjustable rods are commonly used to support curtains, such as window and shower curtains and clothing on hangers. Adjustable rods commonly have two tubes where one slides inside the other one to adjust the relative length of the combined tubes. The adjustable rods include a locking system to set the tubes relative to one another and adjustable end caps to apply the appropriate amount of pressure on a pair of mounting walls between which the rod extends. There is a need to help ensure that the locking system does not become stuck, which may then require disassembly of the system to repair it for operation.

The adjustable rods further include a pair of end caps which contact the mounting walls. The end caps include pads which create friction and improve the stability of the adjustable rods when mounted to the walls. This combined with the pressure applied by the adjustable rods to the mounting walls will secure the rod in place.

Some people, however, are more comfortable with a permanent mount to the wall because it is a more secure attachment. Thus, one known shortcoming with current adjustable tension rods is their inability to also be mounted permanently. Thus, there is a need for a tension rod that can be mounted both temporarily and permanently.

DETAILED DESCRIPTION OF THE PREFERRED EMBODIMENTS

Figure 1:
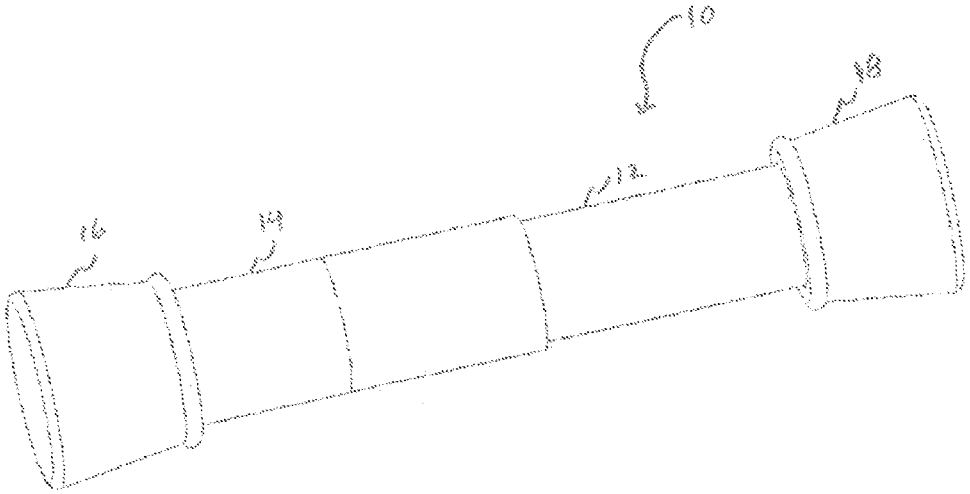
FIG. 1 is a perspective view of an adjustable rod in accordance with a preferred embodiment of the present invention.

With reference to FIG. 1, there is illustrated a universal adjustable rod 10 designed to be easily installed between two walls to support hanging items, such as for supporting a shower curtain in a shower enclosure. The shower rod 10 adjusts in length from a contracted length to an extended length to accommodate different distances between the mounting walls. Once adjusted to a level distance between the mounting walls, the adjustable rod 10 is further adjusted to apply the appropriate amount of force on the walls to facilitate sufficient supporting strength. The adjustment mechanisms described herein permit simple installation of the adjustable rod 10 without undesired walking of the ends of the rod 10 on the mounting wall.

More specifically, the adjustable rod 10 includes an inner tube 12 partially received in an outer tube 14. The inner tube 12 extends telescopically from the outer tube 14 to provide a coarse adjustment of the rod 10 to engage the mounting walls. The outer tube 14 includes a left end cap 16, and the inner tube 12 includes a right end cap 18. The end caps 16, 18 adjust relative to their respective tubes 14, 12 to provide fine adjustments to further apply force against the mounting walls. These adjustments, as explained further below, place the rod 10 in sufficient tension between the mounting walls to enable the rod 10 to support items such as a shower curtain.

With reference to FIGS. 2-14, there is illustrated one embodiment of an adjustment mechanism for the adjustable rod 10. The adjustment mechanism includes a lock assembly 20 intermediate the end caps 16, 18 to lock the inner and outer tubes 12, 14 relative to one another for the coarse adjustment. The adjustment mechanism further includes a left end cap adjustment assembly 22 and a right end cap adjustment assembly 24. The end cap adjustment assemblies 22, 24 provide the fine adjustments to apply the appropriate amount of force against the mounting walls. For the adjustment mechanism of FIG. 2, the inner and outer tubes 12, 14 are roll formed from metal with a longitudinal folded seam along the inside to secure the rounded cross-section (see FIGS. 7 and 8).

The lock assembly 20 includes a lock assembly insert 26 that fits in an inner end portion 28 of the inner tube 12 such that it is fixed against movement relative to the inner tube 12 and a lock disc 30 that is attached to an outer end 32 of the insert 26 that extends beyond an end 34 of the inner tube 12. The lock disc 30 engages an inside surface 36 of the outer tube 14 to enable the tubes 12, 14 to be extended relative to one another but not contracted once extended.

Figure 3:
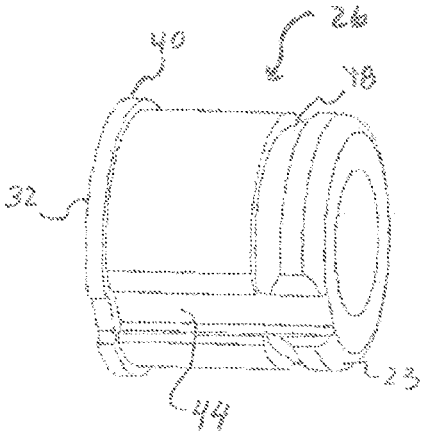
FIG. 3 is a perspective view of an insert of a lock assembly of the adjustment mechanism of FIG. 2.
Figure 4:
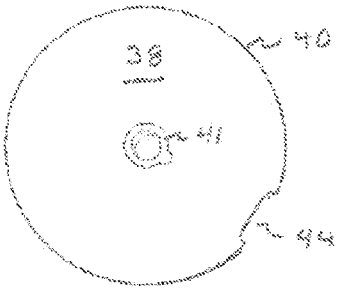
FIG. 4 is a top plan view of the insert of FIG. 3.

With reference to FIGS. 3 and 4, the lock assembly insert 26 has a cylindrical, hollow body configuration with a flat end wall 38 at one end surrounded by a perimeter flange 40 extending radially from the insert 26. The flange 40 engages the end 34 of the inner tube 12 as a stop against complete insertion into the inner tube 12. The flat end wall 38 includes a central threaded bore. The threading may be provided by a metal insert 41 friction fitted into the bore in the flat end wall 38. The outer diameter of the insert 26 is such that it provides a friction fit with an inner surface 42 of the inner end portion 28 of the inner tube 12 to resist unintentional removal from the inner tube 12. The insert 26 includes a longitudinal groove 44 extending the entire length for receiving a folded seam 46 (FIG. 7) to resist rotation of the lock assembly relative to the inner tube 12. The insert 26 also may include a circumferential groove 48 near an inner end 23 of the insert 26. The circumferential groove 48 may be used to further secure the insert 26 in the inner tube 12. A portion of inner tube at the groove 48 can be indented into the groove 48 to provide an interlocking engagement. The insert may be made (e.g., molded) from a rigid plastic material.

Figure 5:
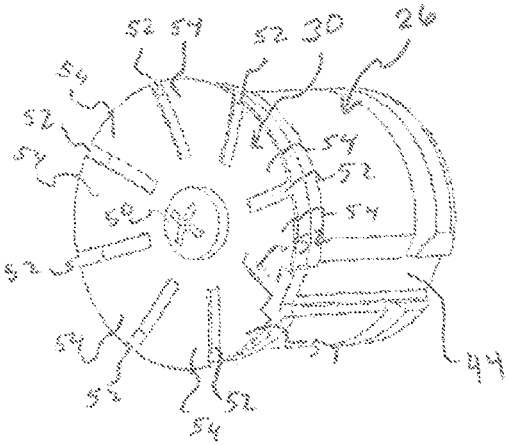
FIG. 5 is a perspective view of the insert of FIG. 3 with a lock disc attached thereto.
Figure 6:
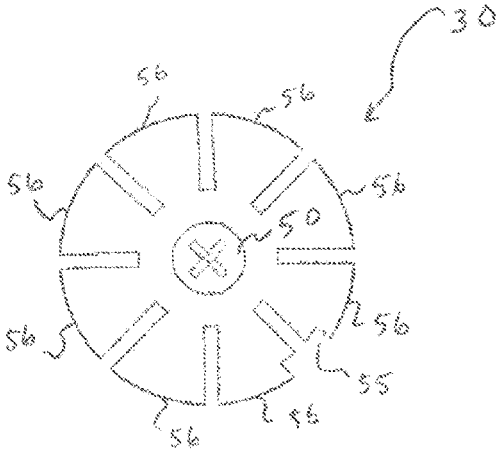
FIG. 6 is a top plan view of the lock disc of FIG. 5.
Figure 7:
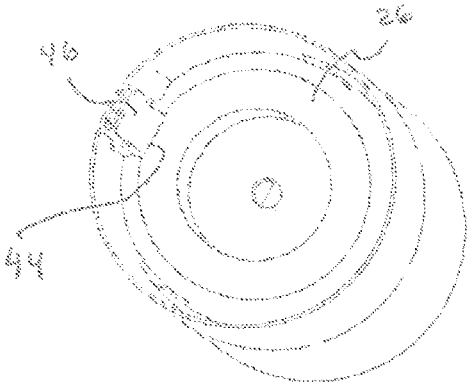
FIG. 7 is a perspective view down an inside of an inner tube of the adjustable rod of FIG. 1 showing the insert of the lock assembly of FIG. 3.
Figure 8:
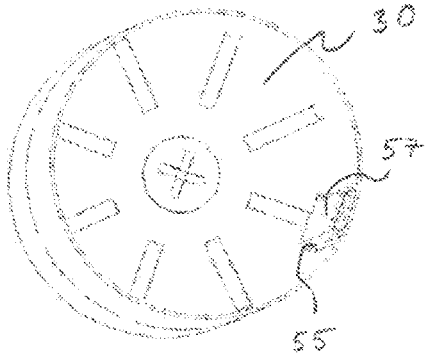
FIG. 8 is a perspective view down an inside of an outer tube of the adjustable rod of FIG. 1 showing the lock disc of FIG. 6.

With reference to FIGS. 5 and 6, the lock disc 30 is attached to the flat end wall 38 of the insert 26 with a threaded screw 50 into the central threaded bore 41. The lock disc 30 includes a series of radial slits 52 that define a series of petals 54 with an arcuate outer edge 56. A seam cutout 55 is located at one of the slits 52. The seam cutout 55 receives the folded seam 57 of the outer tube 12 (FIG. 8).

Figure 2:
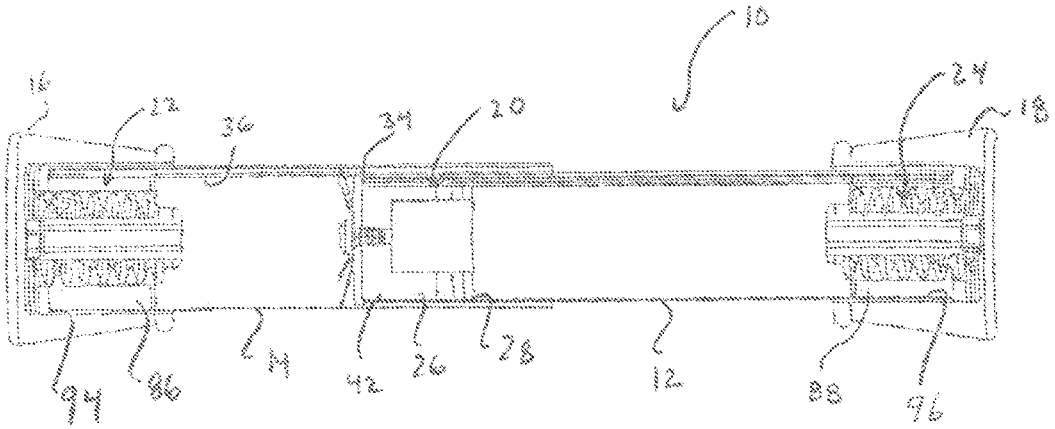
FIG. 2 is a longitudinal cross-section showing an adjustment mechanism for the adjustable rod of FIG. 1.

The petals 54 enable the lock disc 30 to take on a concave shape facing into the outer tube 14 (FIG. 2). The diameter of the lock disc 30 is sufficiently large so that the outer arcuate edge 56 of the petals 54 engages the inner surface 36 of the outer tube 14. The concave shape enables the petals 54 to slide along the inner surface 36 as the inner and outer tubes 12, 14 are extended relative to one another but wedges against the inner surface 36 to prevent contraction of the inner tube 12 into the outer tube 14. This provides a one-way slip lock configuration for the coarse extension of the tubes 12, 14 relative to one another between the mounting walls. The lock disc 30 is preferably made of a metal material, such as spring steel, that retains its shape and is of sufficient integrity to lock against the inner wall 36 of the outer tube 14.

The left and right end cap assemblies 22, 24 are the same except that they are threaded so the rotation of both the inner and outer tubes 12, 14 in the same direction causes both the left and right end caps 16, 18 to translate in opposite directions with respect to one another. That is, rotation of the tubes 12, 14 in clockwise direction when looking at the right end cap 18 causes the end caps 16, 18 to translate away from one another (outward) to apply pressure on the mounting walls to secure the adjustable rod 10 and when rotated in the counterclockwise direction, the end caps 16, 18 move toward each other to release the adjustable rod 10 from the mounting walls. During installation, one simply pulls the tubes 12, 14 apart to the desired length between the mounting walls and without moving his or her hands begins to turn the tubes 12, 14 together in the clockwise direction (i.e., toward his or her body) to translate the end caps 16, 18 outward to apply pressure on the mounting walls to secure the adjustable rod 10.

Figure 9:
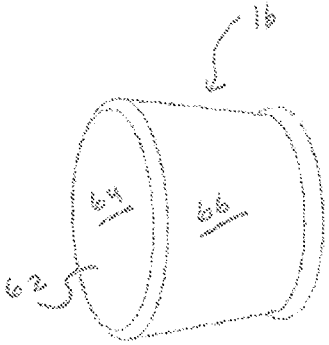
FIG. 9 is a perspective view of a left end cap of the adjustment mechanism of FIG. 2.
Figure 10:
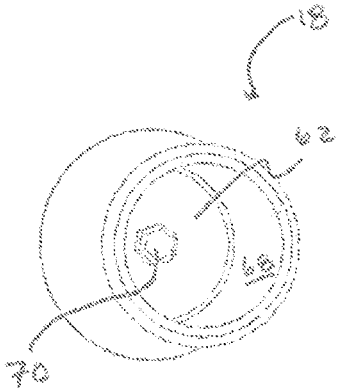
FIG. 10 is a perspective view of a right end cap of the adjustment mechanism of FIG. 2.

With reference to FIGS. 9 and 10, the left end cap 16 and the right end cap 18 are identical. The end caps 16, 18 each include an end wall 62 with an outer surface 64 that is generally flat, a tapering outer surface 66 extending away from the outer surface 64 to the other end of the end cap, and a cylindrical, hollow interior 68. A driver 70 projects from a center of the end wall into the interior 68 of the end cap. The driver 70 may be hexagonal in form. The end caps 16, 18 may be made of a rubber type material designed to provide a friction engagement with the mounting walls to prevent the end caps 16, 18 from rotating and walking on the mounting walls during rotation of the tubes for installation.

Figure 11:
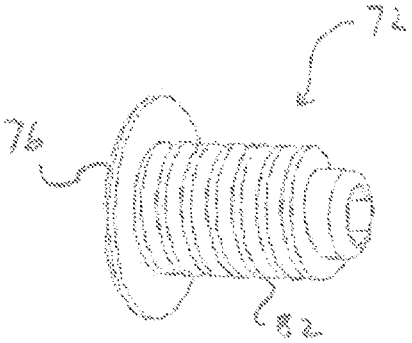
FIG. 11 is a perspective view of a left end cap adjustment screw insert of the adjustment mechanism of FIG. 2.
Figure 12:
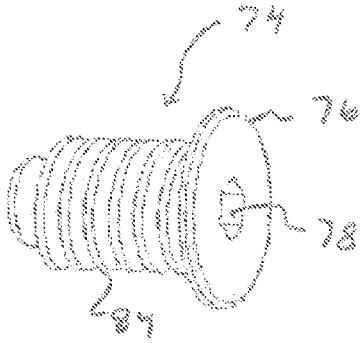
FIG. 12 is a perspective view of a right end cap adjustment screw insert of the adjustment mechanism of FIG. 2.

With reference to FIGS. 11 and 12, the left and right end cap assemblies 22, 24 include a left and right end cap adjustment screw insert 72, 74, respectively. A head 76 of each screw insert 72, 74 includes a drive socket 78 to receive the driver 70 of the end caps 16, 18. The socket may be hexagonal in configuration. The diameter of the head 76 is sized to provide a friction fit with an inner surface 80 of the interior 68 (FIG. 10) of the end caps 16, 18. The left end cap adjustment screw insert 72 includes right-hand threading 82, and the right end cap adjustment screw insert 74 includes a left-hand threading 84. The left and right end cap adjustment screw inserts 72, 74 may be made (e.g., molded) from a rigid plastic material.

Figure 13:
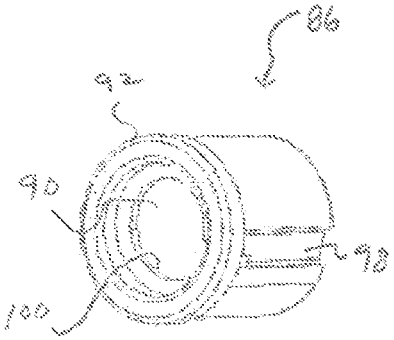
FIG. 13 is a perspective view of a left end outer tube insert of the adjustment mechanism of FIG. 2.
Figure 14:
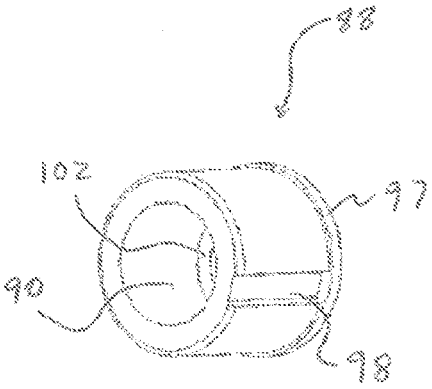
FIG. 14 is a perspective view of a right end inner tube insert of the adjustment mechanism of FIG. 2.
Figure 15:
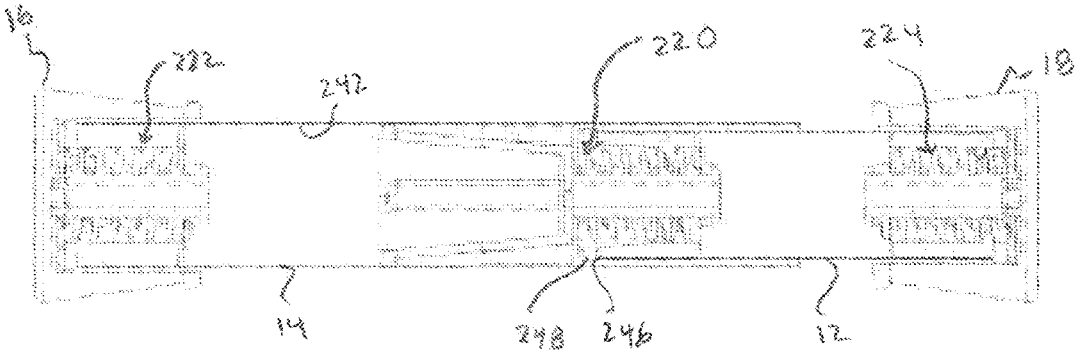
FIG. 15 is a cross-section view of an alternative adjustment mechanism for the adjustable rod of FIG. 1.
Figure 16:
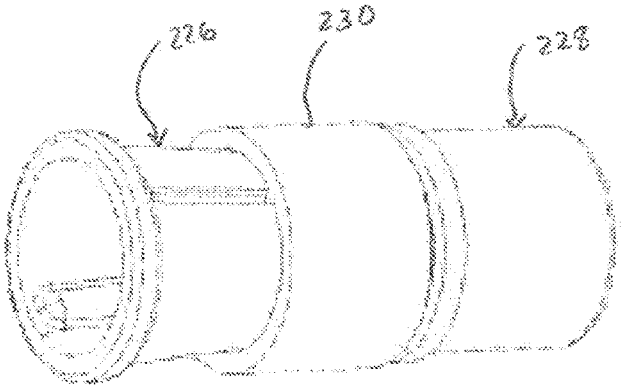
FIG. 16 is a perspective view of a lock assembly for the alternative adjustment mechanism of FIG. 15.
Figure 17:
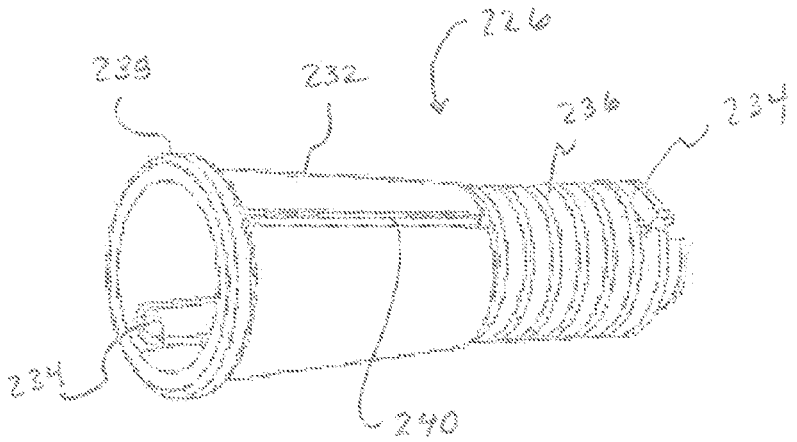
FIG. 17 is a perspective view of a lock ramp of the lock assembly of FIG. 16.
Figure 18:
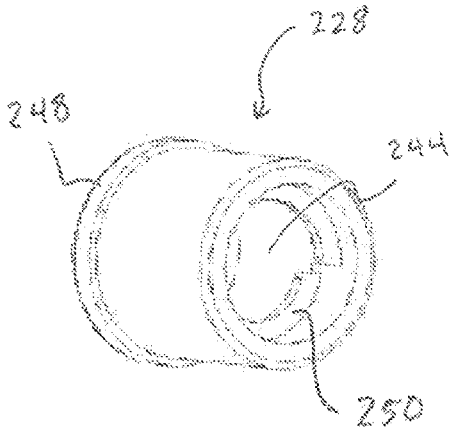
FIG. 18 is a perspective view of an inner tube left end insert of the lock assembly of FIG. 16.
Figure 19:
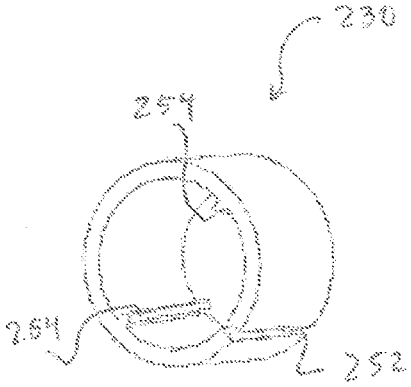
FIG. 19 is a perspective view of a lock sleeve of the lock assembly of FIG. 16.

With reference to FIGS. 13 and 14, the left and right end cap assemblies 22, 24 include a left and right end tube insert 86, 88, respectively. Each insert 86, 88 is generally cylindrical with a hollow pass through 90. The left end cap insert 86 fits with a friction fit in a left end 94 of the outer tube 14, and the right end cap insert 88 fits in a right end 96 of the inner tube 12 with a friction fit (FIG. 2). An outer diameter of the left end cap insert 86 is slightly larger than that of the right end cap insert 88 to accommodate a larger diameter of the outer tube 14. A circumferential flange 92 extends about the perimeter of one end of the left and right end cap inserts 86, 88 for engaging the left and right ends 94, 96 of the outer and inner tubes 14, 12 respectively, to prevent complete insertion therein. Each insert 86, 88 includes a longitudinal extending groove 98 that receives the outer tube seam 57 and the inner tube seam 46, respectively. This engagement fixes the left and right end tube inserts 86, 88 for rotation with the outer and inner tubes 14, 12 during installation.

The left end cap insert 86 includes a left-hand thread 100 in its interior 90, and the right end cap insert 88 includes a right-hand thread 102 in its interior 90. The right and left-hand threads 100, 102 cooperate with the right and left-hand threading 82, 84 of the right and left end cap adjustment screw inserts 72, 74. These threading engagements enable the end caps 16, 18 to move away from one another as the tubes 12, 14 are rotated during installation. More specifically, the friction between the mounting walls and the end surfaces 64 of the end caps 16, 18 limits rotation of the end caps 16, 18 as the tubes 12, 14 are rotated. The driver 70 of the end caps 16, 18 and the sockets 78 lock the left and right end cap adjustment screw inserts 72, 74 against rotation relative to the end caps 16, 18. Accordingly, as the tubes 12, 14 are rotated toward an installer, the left and right end tube inserts 86, 88 are turned, causing the end caps 16, 18 to move away from one another, thereby applying force on the mounting surface to further lock the adjustable rod 10 to the mounting walls. Rotating the tubes 12, 14 away from the installer causes the end caps to move towards one another, thereby removing force from the mounting surface to uninstall the adjustable rod 10. The left and right end cap inserts 72, 74 may be made (e.g. molded) from a rigid plastic material.

To install the adjustable rod 10 with the locking mechanism 20 and the left and right end cap adjustment assemblies 22, 24, the outer tube 14 is held with one's left hand, and the inner tube 12 is held with one's right hand. The tubes 12, 14 are extended from one another until their respective end caps 16, 18 engage the mounting walls. Next, one rotates both the inner and outer tubes 12, 14 in the same direction toward one's body (i.e., clockwise looking at the right end cap 18). This will cause the end caps 16, 18 to move away from one another to provide the appropriate force on the mounting walls to secure the adjustable rod 10. The tubes 12, 14 can be rotated in the opposite direction to release the pressure to remove the adjustable rod 10, such as for repositioning.

With reference to FIGS. 15-19, there is illustrated another embodiment of an adjustment mechanism for the adjustable rod 10. The adjustment mechanism includes a lock assembly 220 intermediate the end caps 16, 18 to lock the inner and outer tubes 12, 14 relative to one another for the coarse adjustment. The adjustment mechanism further includes a left end cap adjustment assembly 222 and a right end cap adjustment assembly 224. The end cap adjustment assemblies 222, 224 provide the fine adjustments to apply the appropriate amount of force against the mounting walls. The end cap assemblies 222 and 224 are identical to the end cap assemblies 22 and 24 discussed above. For the adjustment mechanism of FIG. 15, the inner and outer tubes 12, 14 are roll formed from metal with a longitudinal welded seam along the inside to secure the rounded cross-section.

With reference to FIGS. 16-19, the lock assembly 220 includes a lock ramp 226, an inner tube left end insert 228, and a lock sleeve 230. The lock ramp 226 and the inner left end insert 228 may be molded from a rigid plastic material. The lock sleeve 230 also may be molded from rigid type plastic but must be flexible enough to expand and provide a sufficient frictional engagement with an inner surface 242 of the outer tube 14 to lock the tubes against relative movement.

The lock ramp 226 includes a frusto-conical wedge portion 232 and a threaded portion 234 with a right-hand thread 236. The wedge portion 232 includes a circumferential flange 238 at its free end and a pair of diametrically opposed grooves 240 extending longitudinally from the flange 238 to the threaded portion 234. The flange 238 centers the lock ramp 226 in the outer tube 14 and provides a small amount of frictional engagement with an inner surface 242 of the outer tube 14. The longitudinal grooves 240 guide longitudinal movement of the lock sleeve 230 along the wedge portion 232.

The inner tube left end insert 228 is generally a hollow cylindrical shape with a through hole 244. The insert 228 fits with a friction fit in a left end 246 of the inner tube 12. A circumferential flange 248 extends about a perimeter of one end of the insert 228 for engaging the left end 246 of the inner tube 12 to prevent complete insertion therein. The friction engagement in the inner tube 12 fixes the insert 228 against rotation relative to the inner tube 12. The insert 228 includes a left-hand thread 250 in its interior. The thread 236 of the threaded portion 234 of the lock ramp 226 meshes with the thread 250 of the insert 228. As the threaded portion 234 is turned into the insert 228, the lock sleeve 230 expands to lock the tubes 12, 14 relative to one another.

More specifically, the lock sleeve 230 has an elongated slot 252 along its entire axial length to form a split ring configuration. This enables the lock sleeve 230 to be expanded from a first state that allows relative movement of the tubes 12, 14 to a second state to lock the tubes 12, 14 against relative movement. The lock sleeve 230 includes a pair of longitudinally extending ribs 254 on its inside that are offset 90 degrees from the slot 252. The lock sleeve 230 receives the wedge portion 232 of the lock ramp 226 with the ribs 254 in each one of the grooves 240 of the lock ramp 226.

To install the adjustable rod 10 with the locking mechanism 220 and the left and right end cap adjustment assemblies 222, 224, the outer tube 14 is held with one's left hand, and the inner tube 12 is held with one's right hand. The tubes 12, 14 are extended from one another until their respective end caps 16, 18 engage the mounting walls. Then, the outer tube 14 is held stationary with the left hand, and the inner tube 12 is rotated clockwise (when looking at the right end cap 18—i.e., toward an installer's body) with the right hand. This causes the threaded engagement between the lock ramp 226 and the insert 228 to draw the wedge portion 232 toward the insert 228 which, in turn, causes the wedge portion 232 to push into the lock sleeve 230 guided by the grooves 240 and ribs 254 and expand the lock sleeve 230. Once expanded sufficiently, the lock sleeve 230 becomes wedged tightly between the wedge portion 232 and the inner surface 242 of the outer tube 14 causing the inner and outer tubes 12, 14 to be locked against relative movement.

Next, one rotates both the inner and outer tubes 12, 14 in the same direction toward the one's body (i.e., clockwise looking at the right end cap 18). This will cause the end caps 16, 18 to move away from one another to provide the appropriate force on the mounting walls to secure the adjustable rod 10. The tubes 12, 14 can be rotated in the opposite direction to release the pressure to remove the adjustable rod 10, such as for repositioning.

Figure 20:
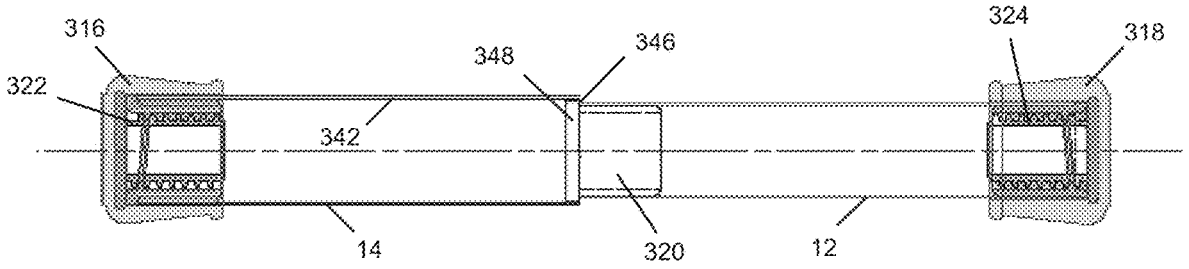
FIG. 20 is a cross-section view of an alternative adjustment mechanism for the adjustable rod of FIG. 1.

With reference to FIG. 20, there is illustrated another embodiment of an adjustment mechanism for the adjustable rod 10. The adjustment mechanism includes a lock assembly 320 intermediate the end caps 316, 318 to lock the inner and outer tubes 12, 14 relative to one another for the coarse adjustment. The adjustment mechanism further includes a left end cap adjustment assembly 322 and a right end cap adjustment assembly 324. The end cap adjustment assemblies 322, 324 provide the fine adjustments to apply the appropriate amount of force against the mounting walls. The end cap assemblies 322 and 324 are identical to the end cap assemblies 422 and 424 discussed below. The end caps 316 and 318 are identical to the end caps 416 and 418 discussed below. In alternative embodiments, the end cap assemblies 322 and 324 can be replaced with the end cap assemblies 22 and 24 discussed above and the end caps 316 and 318 are replaced with the end caps 16 and 18 discussed above. For the adjustment mechanism of FIG. 20, the inner and outer tubes 12, 14 are roll formed from metal with a longitudinal welded seam along the inside to secure the rounded cross-section. This can be done with a laser to provide a smooth interior and exterior.

Figure 21:
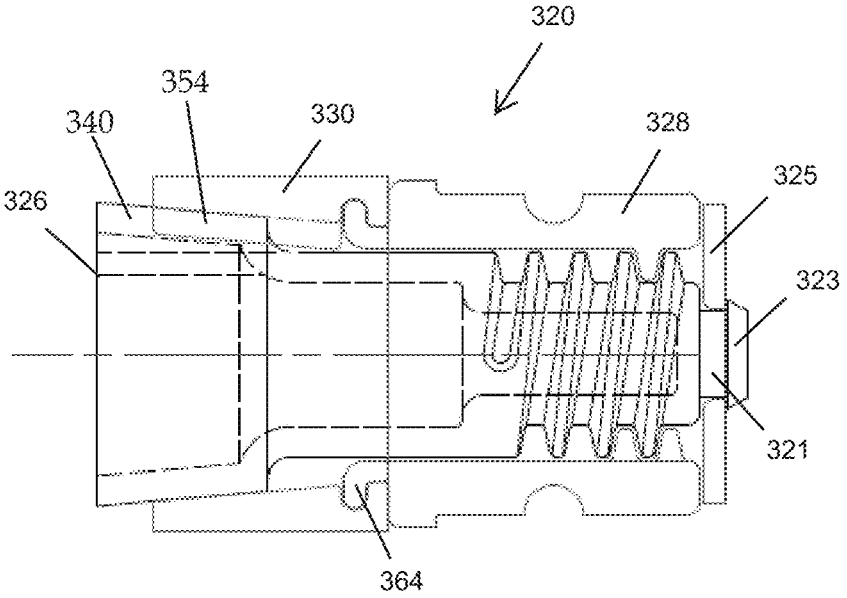
FIG. 21 is a cross-section view of a lock assembly for the alternative adjustment mechanism of FIG. 20.
Figure 22:
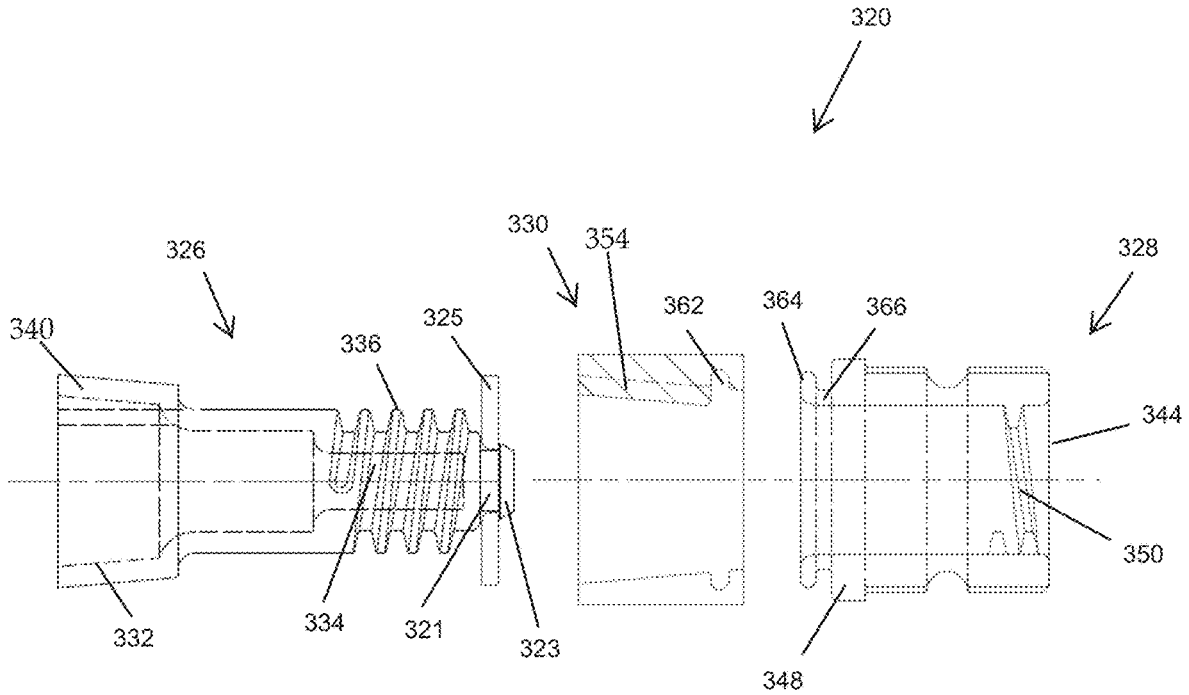
FIG. 22 is an exploded cross section view of the lock assembly of FIG. 21.
Figure 23:
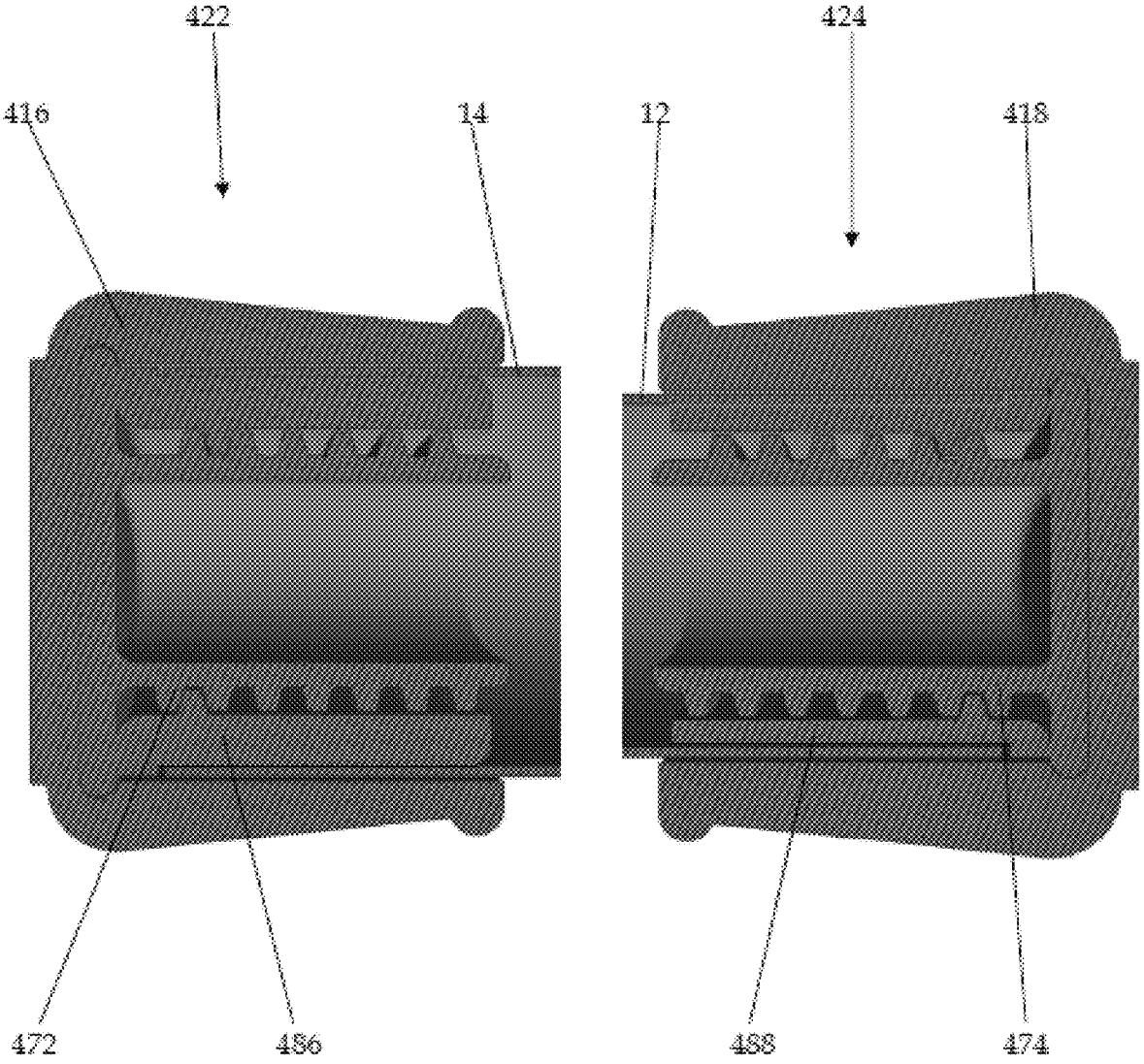
FIG. 23 is a cross-section view of an alternative end cap assembly for the adjustable rod of FIG. 1.

With reference to FIGS. 21-22, the lock assembly 320 includes a lock ramp 326, an inner tube left end insert 328, and a lock sleeve 330. The locking assembly 320 operates very similarly to the locking assembly 220 described above. Corresponding parts in the two embodiments share the same last two digits in the reference numbers. The lock ramp 326 and the inner left end insert 328 may be molded from a rigid plastic material, such as acrylonitrile butadiene styrene (ABS). The lock sleeve 330 also may be molded from a rigid type plastic (such as ABS) but must be flexible enough to expand and provide a sufficient frictional engagement with an inner surface of the outer tube to lock the tubes against relative movement.

The lock ramp 326 includes a frusto-conical wedge portion 332 and a threaded portion 334 with a right hand thread 336. The wedge portion 332 includes a groove 340 extending longitudinally from its free end (the left end in FIGS. 20-21) to the threaded portion 334. The longitudinal groove 340 guides longitudinal movement of the lock sleeve 330 along the wedge portion 332. In alternative embodiments, the lock ramp 326 may include a flange at its free end to help center the lock ramp 326 in the outer tube 14 and provides a small amount of frictional engagement with an inner surface 342 of the outer tube 14.

The lock ramp 326 further includes an annular groove 321 at the end of the threaded portion 334. The annular groove 321 is defined by the threaded portion 334 and a truncated cone 323. The truncated cone 323 decreases in diameter further from the annular groove 321 and as it proceeds to its terminal end. It is made out of a deformable material, so that a stop washer 325 can be pushed over the truncated cone 323 to rest in the annular groove 321. The wide end of the truncated cone 323 prevents the stop washer 325 from separating from the lock ramp 326. The stop washer 325 has an outer diameter greater than the inner diameter of the insert 328, and thus prevents the insert 328 and the lock ramp 326 from being separated.

In assembly, the lock ramp 326 is extended through the lock sleeve 330 and the left end insert 328 so that the truncated cone 323 extends out the end of the left end insert 328 furthest from the frusto-conical wedge portion 332 of the lock ramp 326. The stop washer 325 is then mounted onto the lock ramp 326. The cam surface of the truncated cone 323 deforms to allow the stop washer 325 to slip over the edge and into the annular groove 321. The stop washer 325 may be made of a plastic (such as ABA) so that the inner edge of the stop washer 325 deforms to assist with installing of the stop washer 325 on to the end of the lock ramp 320. Once in the annular groove 321, the stop washer 325 abuts the edge of the wide stop surface of the truncated cone 323. The wide edge of the truncated cone 323 is only slightly, but sufficiently, larger than the hole in the stop washer 325, so as to prevent the assembly from separating while in use but still allowing easy assembly. Thus, the lock ramp 326 is installed into the insert 328 before installation of the stop washer 325.

The inner tube left end insert 328 has a generally hollow, generally cylindrical shape with a through hole 344. The insert 328 fits with a friction fit in a left end 346 of the inner tube 12. An annular flange 348 extends about a perimeter of one end of the insert 328 for engaging the left end 346 of the inner tube 12 to prevent complete insertion therein. An annular protrusion 366 extends from the annular flange 348. The protrusion 366 includes an annular neck 363 and a terminal, annular lip 364. The lip snap 364 fits into an annular groove 362 defined by the interior surface of the lock sleeve 330. This captivates the lock sleeve 330 to the insert 328. The groove 362 is deep enough so that the lip 364 does not prevent the lock sleeve 330 from contracting when the lock assembly 320 is loosened. The lip 364 extends far enough into the groove 362 that the parts do not decouple when the lock sleeve 330 is fully expanded to lock the tubes 12, 14 together. The friction engagement in the inner tube 12 fixes the insert 328 against rotation relative to the inner tube 12. In alternative embodiments, the insert 328 may include a groove that interacts with a seam of the inner tube 12 to fix the insert 328 against rotation relative to the inner tube 12. In other alternative embodiments, the inner tube 12 may be spiked to the insert 328 by causing indentation in the inner tube 12 with a punch. The insert 328 includes a left hand thread 350 in its interior. The thread 336 of the threaded portion 334 of the lock ramp 326 meshes with the thread 350 of the insert 328.

The lock sleeve 330 has an elongated slot 352 (see slot 252 in FIG. 19) along its entire axial length to form a split ring configuration. This enables the lock sleeve 330 to be expanded from a first state that allows relative movement of the tubes 12, 14 to a second state to lock the tubes 12, 14 against relative movement. The lock sleeve 330 includes a longitudinally extending rib 354 on its inside. The lock sleeve 330 receives the wedge portion 332 of the lock ramp 326 with the rib 354 received in the groove 340 of the lock ramp 326 to enable the lock sleeve to rotate with the lock ramp 326. The engagement between the groove 362 and the lip 364 allows the lock sleeve to rotate relative to the insert 328.

In an alternative embodiment, the insert 328 does not have a circumferential flange 348 sized to prevent insertion of the insert 328 entirely into the tube. In this case, the lock sleeve 330 engages the left end 346 of the inner tube 12. With the lock sleeve 330 and the insert 328 connected by the lip 364, the lock sleeve 330 can serve the purpose of the annular flange 348.

As the threaded portion 334 is turned into the insert 328, the lock sleeve 330 expands to lock the tubes 12, 14 relative to one another. As the threaded portion 334 is turned out of the insert 328, the lock sleeve 330 contracts, allowing the tubes 12, 14 to move relative to one another. The coupling of the lip 364 and the groove 362 prevent the lock sleeve 330 from moving with the frusto-conical wedge portion 332 as a result of friction when the tubes 12, 14 are free to move longitudinally relative to one another. Because the inner surface of the outer tube 14 and the outer surface of the lock sleeve 330 are smooth, minimal clearance is needed to allow movement of the tubes 12, 14 relative to each other. In one embodiment, the diameter of the lock sleeve 330 in an expanded state is between 0.0025 and 0.025 inches larger than the diameter of the lock sleeve 330 in an unexpanded state. As the tubes 12, 14 move toward one another, the annular flange 348 prevents the insert 328 from moving relative to the tube 12. As the tubes 12, 14 move apart, the friction between the insert 328 and the tube 12 prevents the insert 328 from moving relative to the tube 12. The washer 325 couples the lock ramp 326 to the insert 328 to prevent separation of the components. The engagement of the lip 364 with the groove 362 prevents the lock sleeve 330 from decoupling from the insert 328. As such, the lock assembly 320 is captivated so that adjustment of the adjustable rod 10 will not result in the separation of the components of the lock assembly 320.

To install the adjustable rod 10 with the locking mechanism 320 and the left and right end cap adjustment assemblies 322, 324, the outer tube 14 is held with one's left hand, and the inner tube 12 is held with one's right hand. The tubes 12, 14 are extended from one another until their respective end caps 316, 318 engage the mounting walls. Then, the outer tube 14 is held stationary with the left hand, and the inner tube 12 is rotated clockwise (when looking at the right end cap 318—i.e., toward an installer's body) with the right hand. This causes the threaded engagement between the lock ramp 326 and the insert 328 to draw the wedge portion 332 toward the insert 328 which, in turn, causes the wedge portion 332 to push into the lock sleeve 330 guided by the groove 340 and rib 354 and expand the lock sleeve 330. Once expanded sufficiently, the lock sleeve 330 becomes wedged tightly between the wedge portion 332 and the inner surface 342 of the outer tube 14 causing the inner and outer tubes 12, 14 to be locked against longitudinal relative movement.

Next, one rotates both the inner and outer tubes 12, 14 in the same direction toward the one's body (i.e., clockwise looking at the right end cap 318). This will cause the end caps 316, 318 to move away from one another to provide the appropriate force on the mounting walls to secure the adjustable rod 10. The tubes 12, 14 can be rotated in the opposite direction to release the pressure to remove the adjustable rod 10, such as for repositioning.

With reference to FIGS. 23-26, there is illustrated another embodiment of an end cap assembly for the adjustable rod 10, mentioned above. The end cap assemblies 422, 424 shown in FIG. 23 can be combined in a adjustable rod 10 with any of the locking mechanisms discussed above.

Figure 24:
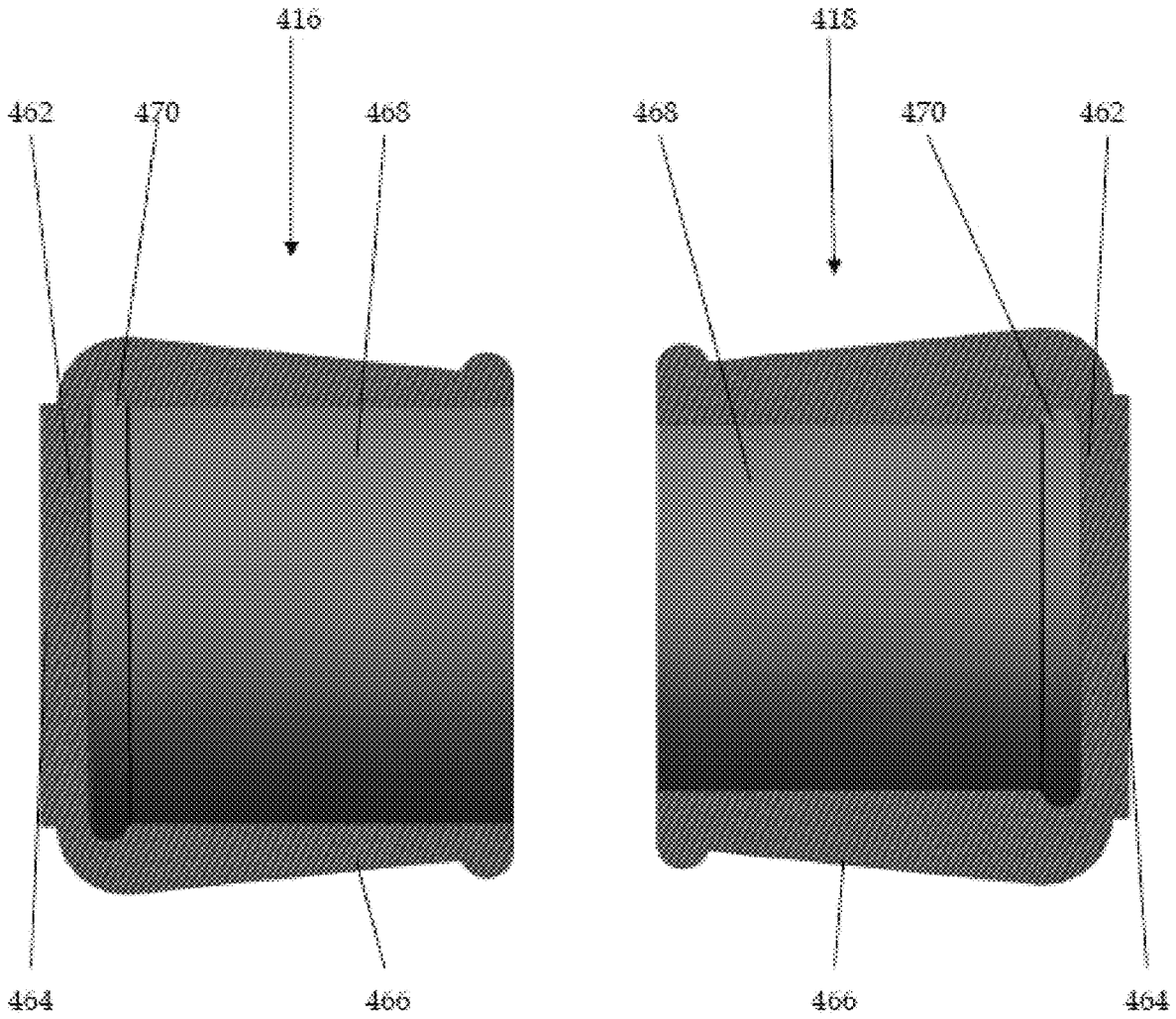
FIG. 24 is a cross-section view of the end caps for the assembly of FIG. 23.

In FIG. 24, the left end cap 416 and the right end cap 418 are nearly identical. The end caps 416, 418 each include an end wall 462 with an outer surface 464 that is generally flat, a tapering outer surface 466 extending away from the outer surface 464 to the other end of the end cap 416, 418, and a cylindrical, hollow interior 468. The interior surface 468 of the end cap 416 is sized to fit over the outer surface of the outer tube 14 such that friction between the interior surface 468 and outer surface of the outer tube 14 are minimized or eliminated. The interior surface 468 is sized to fit over the outer surface of the inner tube 12 such that friction between the interior surface 468 and outer surface of the inner tube 12 are minimized or eliminated. In addition, the interior surfaces 468 can be made smooth in order to minimize friction between the end caps 464 and the tubes 12, 14.

There is an annular groove 470 in the interior 468 of the end cap 416, 418 at the end wall 462. The end caps 416, 418 may be made of a rubber type material designed to provide a friction engagement with the mounting walls to prevent the end caps from rotating and walking on the mounting walls during rotation of the tubes for installation.

Figure 25:
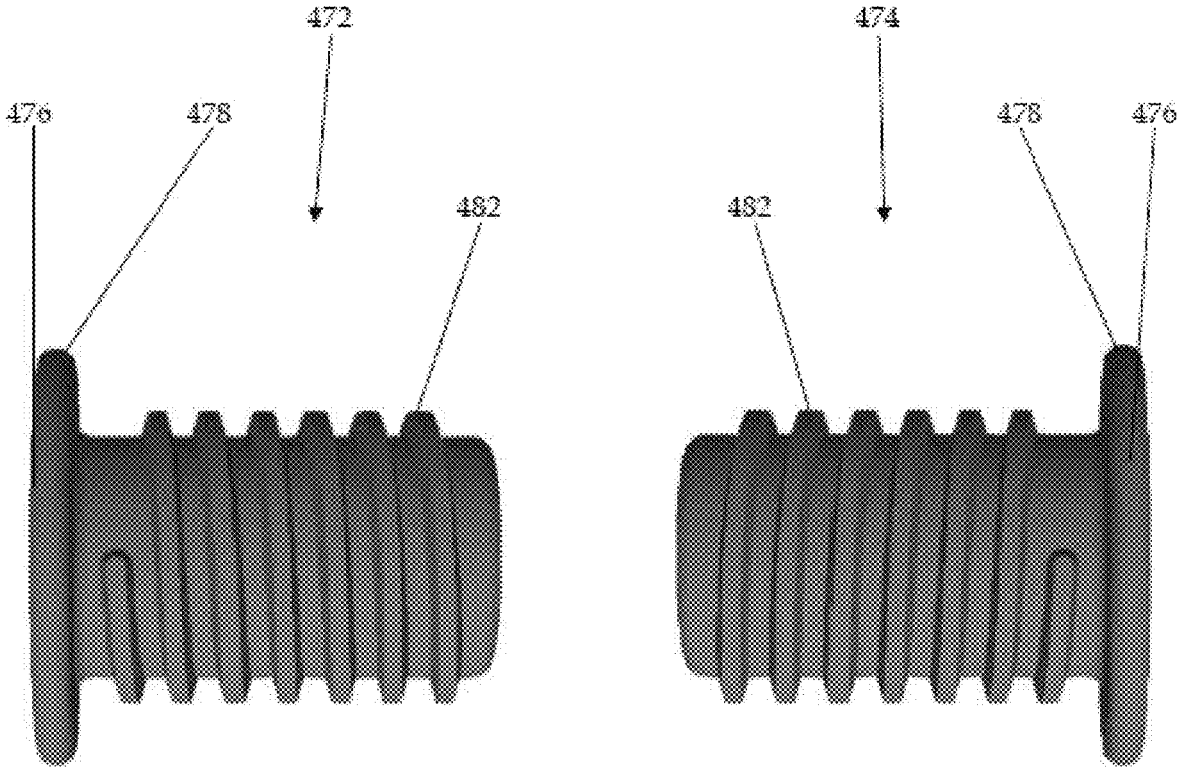
FIG. 25 is a cross-section view of the screw inserts for the assembly of FIG. 23.

With reference to FIG. 25, the left and right end cap assemblies 422, 424 include a left and right end cap adjustment screw insert 472, 474, respectively. A head 476 of each screw insert 472, 474 includes an outer surface 478 that fits within the annular groove 470 of the end caps 416, 418. The diameter of the head 76 is sized to provide a friction fit with the annular groove 470 of the end caps 416, 418. The friction engagement between the head 476 and the annular groove 470 should be greater than any friction between the interior surface 468 of the end caps 416, 418 against tubes 12, 14. Thus, when the adjustable rod 10 is rotated, the friction fixes the end caps 416, 418 and the screw inserts 472, 474 against rotation. This causes the screw inserts 472, 474 to unscrew from the rotating inserts 486, 488 causing the expansion of the adjustable rod 10 to fill the gap between the two walls. The friction between the end caps 416, 418 and the wall can vary based on the material and design of the end caps 416, 418 and/or the walls. Based on the design of the outer surface 464 of the end caps 416, 418, the surface of the head 476 and/or the interior surface 468 of the end caps 416, 418 can be altered to adjust the friction therebetween. This includes changing the materials, changing the roughness or smoothness of the surfaces, or adding features such as ridges to increase friction. The left end cap adjustment screw insert 472 includes right hand threading 482, and the right end cap adjustment screw insert 474 includes left hand threading 484. The left and right end cap adjustment screw inserts 472, 474 may be made (e.g., molded) from a rigid plastic material, such as ABS.

Figure 26:
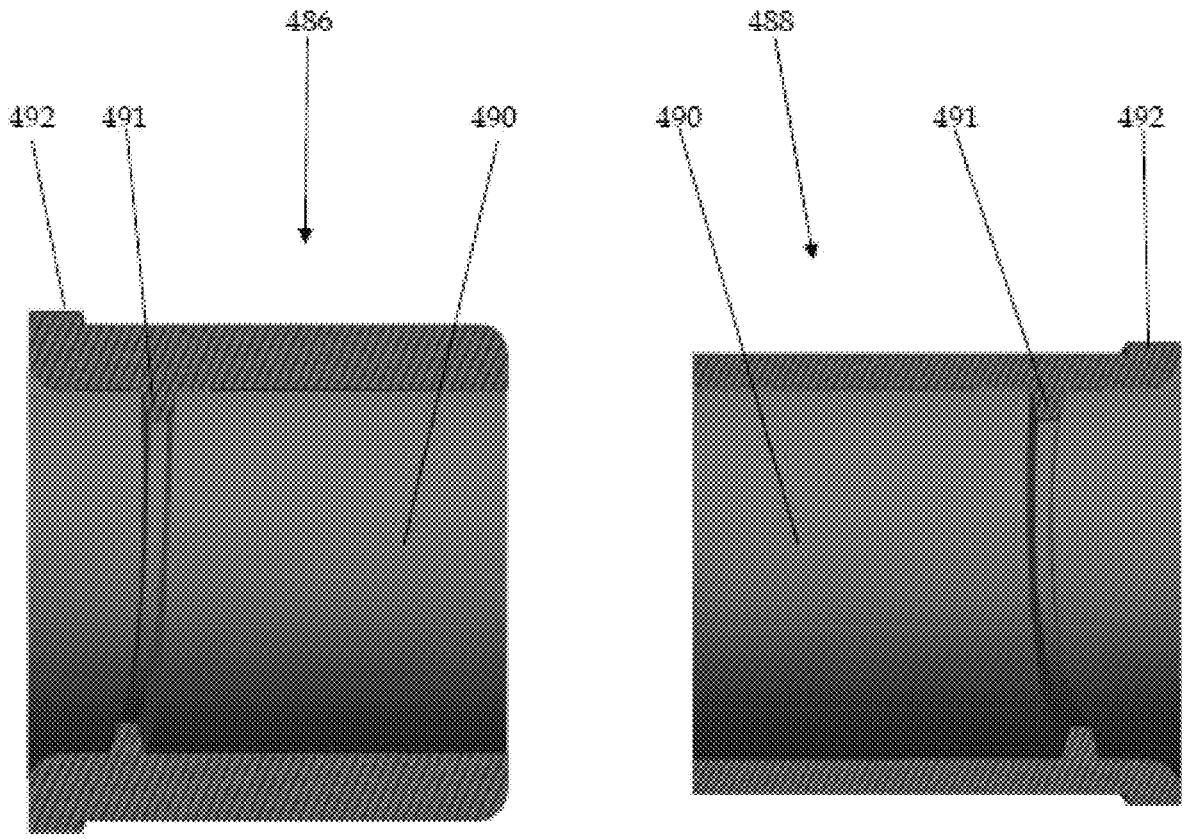
FIG. 26 is a cross-section view of the tube inserts for the assembly of FIG. 23.

With reference to FIG. 26, the left and right end cap assemblies 422, 424 include a left and right end tube insert 486, 488, respectively. Each insert 486, 488 is generally cylindrical with a hollow pass through 490. The left end cap insert 486 fits with a friction fit in a left end 94 of the outer tube 14, and the right end cap insert 488 fits in a right end 96 of the inner tube 12 with a friction fit (see, e.g., FIG. 2). In alternative embodiments, a punch may be used to dent the tubes 12, 14 into the inserts 486, 488 after insertion in order to further secure them in place. In other alternative embodiments, the tubes 12, 14 may include a rolled seam that interacts with a groove in the inserts 486, 488 to fix the inserts 486, 488 against rotation. An outer diameter of the left end cap insert 486 is slightly larger than that of the right end cap insert 488 to accommodate a larger diameter of the outer tube 14. An annular flange 492 extends about the perimeter of one end of the left and right end cap inserts 486, 488 for engaging the left and right ends 94, 96 of the outer and inner tubes 14, respectively, to prevent complete insertion therein.

The left end cap insert 486 includes a left hand thread 491 in its interior 490, and the right end cap insert 488 includes a right hand thread 493 in its interior 490. The right and left hand threads 491, 493 cooperate with the right and left hand threading 482, 484 of the right and left end cap adjustment screw inserts 472, 474. These threading engagements enable the end caps 416, 418 to move away from one another as the tubes 12, 14 are rotated in the same direction during installation. More specifically, the friction between the mounting walls and the end surfaces 464 of the end caps 416, 418 limits rotation of the end caps 416, 418 as the tubes 12, 14 are rotated. The friction between the interior surface 468 of the end caps 416, 418 and the outer surface 478 of the adjustment screw inserts 472, 474 lock the left and right end cap adjustment screw inserts 472, 474 against rotation relative to the end caps 416, 418. Accordingly, as the tubes 12, 14 are rotated toward an installer, the left and right end tube inserts 486, 488 are turned causing the end caps 416, 418 to move away from one another, thereby applying force on the mounting surface to further lock the adjustable rod 10 to the mounting walls. Rotating the tubes 12, 14 away from the installer causes the end caps to move towards one another, thereby removing force from the mounting surface to uninstall the adjustable rod 10. The left and right end cap inserts may be made, such as molded, from a rigid plastic material, such as ABS.

Figure 27:
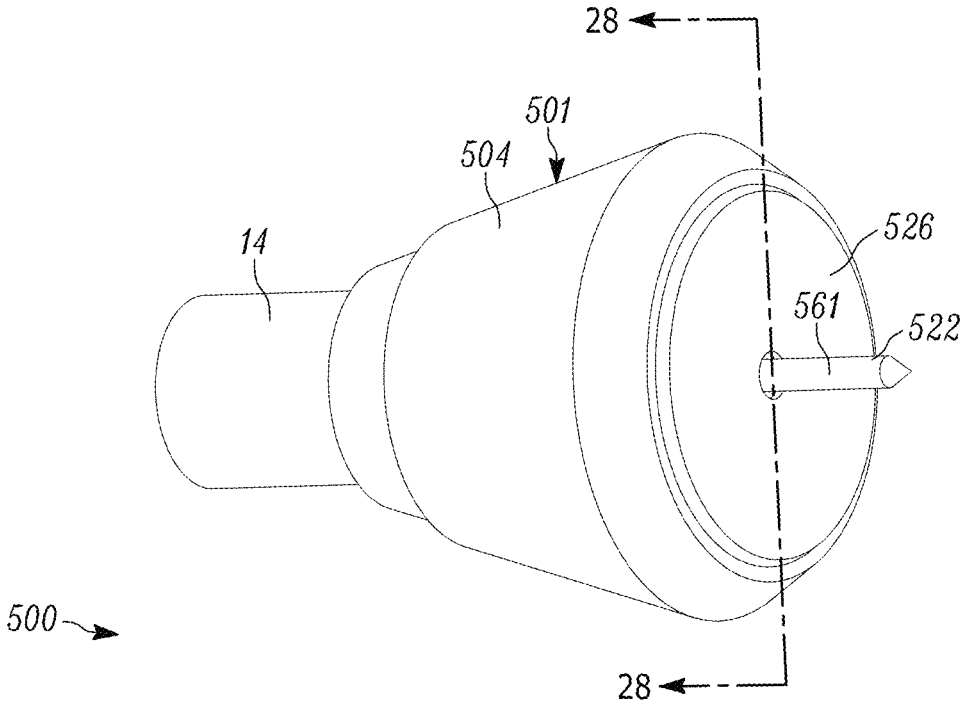
FIG. 27 is a perspective view of end cap assemblies for a dual-mount end cap system.
Figure 27:
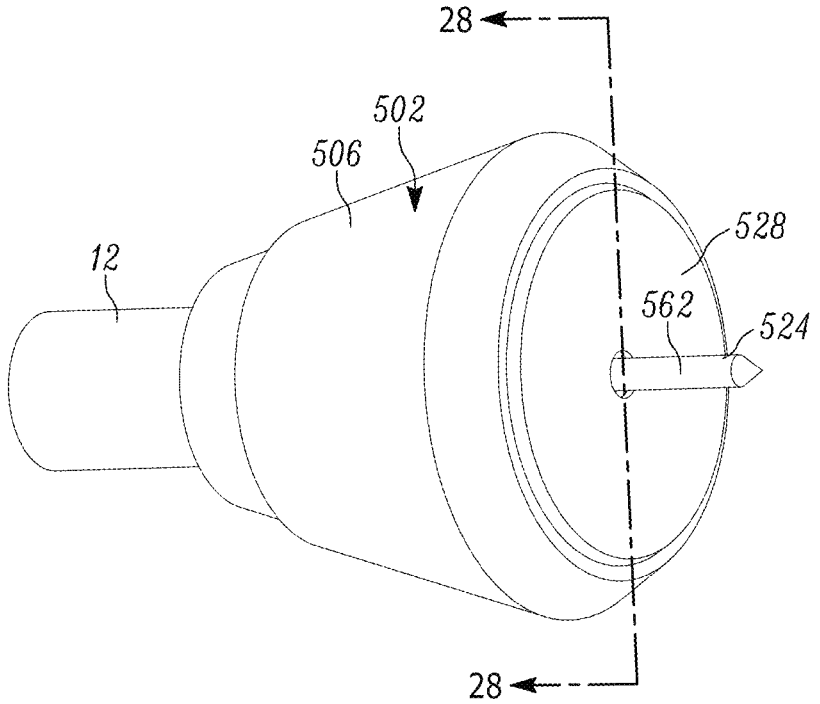
Figure 28:
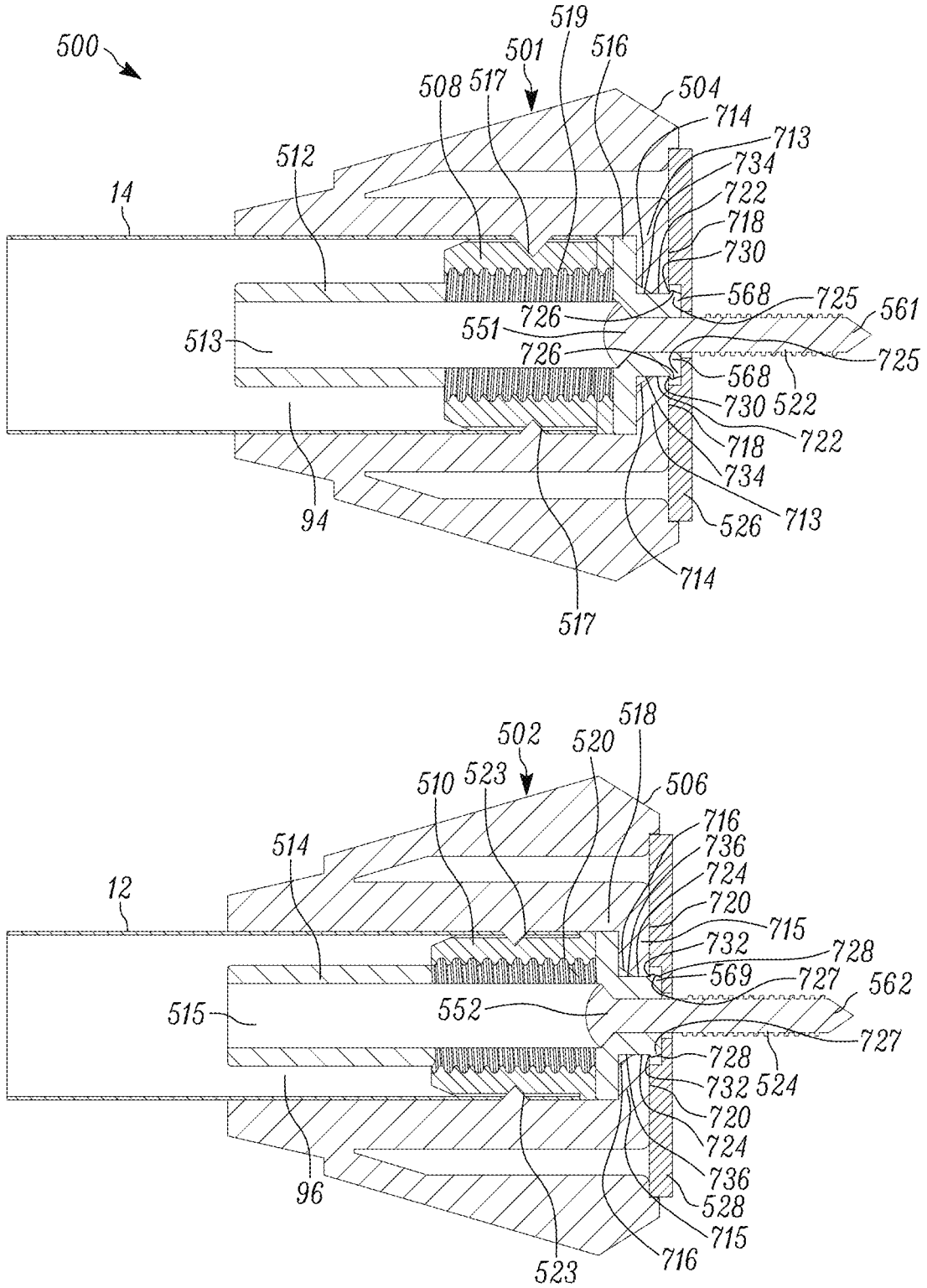
FIG. 28 is a cross-section view of end cap assemblies for a dual-mount end cap system taken across line 28-28.

With reference to FIGS. 27 and 28 there is illustrated a dual-mount end cap system 500. The dual-mount end cap system 500 receives the ends of the inner and outer tubes 12, 14 of the adjustable rod 10 described above. The dual-mount end cap system 500 can be used with any of the above described adjustment and lock mechanisms for the tubes 12, 14.

In general, the dual-mounted end cap system 500 includes a left end cap assembly 501 and a right end cap assembly 502. The left and right end cap assemblies 501, 502 include left and right endcaps 504, 506, left and right threaded tube inserts 508, 510, left and right threaded endcap inserts 512, 514, fasteners 522, 524, and pads 526, 528. The left and right cap inserts 512, 514 include a passage 513, 515, a flange 516, 518, a left-hand threaded portion 519 on the left threaded insert 512, a right-hand threaded portion 520 on the right threaded insert 514, and a head 568, 569.

The threaded tube inserts 508, 510 are captivated in part in the outer and inner tubes 14, 12, respectively, by, for example, creating a pair of detents 517, 523 in the interior surface of the tubes 14, 12 which penetrate a body portion 566, 567 of the inserts 508, 510 (see FIG. 32) to prevent the inserts 508, 510 from becoming separated from the outer and inner tubes 14, 12. While a pair of notches are shown, there may be any number of notches to captivate these parts. There are also ribs 601 on the exterior of the tube inserts 508, 510 to provide friction to hold the tube inserts 508, 510 in the inner and outer tubes 14, 12. The ribs 601 can deform as the tube inserts 508, 510 are inserted to provide a compression fit in the inner and outer tubes 14, 12.

The adjustable rod 10 can be set using one of the above adjustment mechanisms to set the tubes 12, 14 relative to one another and then can be turned so that the end cap assemblies 526, 528 extend outward from the outer tubes 12, 14 to tighten against the two surfaces. Alternatively, the end cap assemblies 501, 502 can be used by themselves to mount the adjustable rod 10 between two surfaces. That is, the fasteners 522, 524 can also be used to pre-mount the end cap assemblies 501, 502 to the surfaces. For example, the end cap assemblies 501, 502 can be first mounted to the walls at the desired locations with the fasteners 522, 524. Then, the adjustable rod 10 can be expanded and the ends of the tubes 12, 14 can be inserted into the end cap assemblies 501, 502. This aids in positioning of the adjustable rod 10 at its desired orientation (e.g., right height, lateral position and level). When the adjustable rod 10 is turned to operate the threaded tube inserts 508, 510 and the threaded cap inserts 512, 514, the end caps 504, 506 are prevented from moving or walking around on the mounting surfaces. It has been found that the rod 10 can support more weight when use the end cap assemblies 501, 502 with the permanent mount fastener 522, 524. This provides some people with additional comfort.

Figure 29:
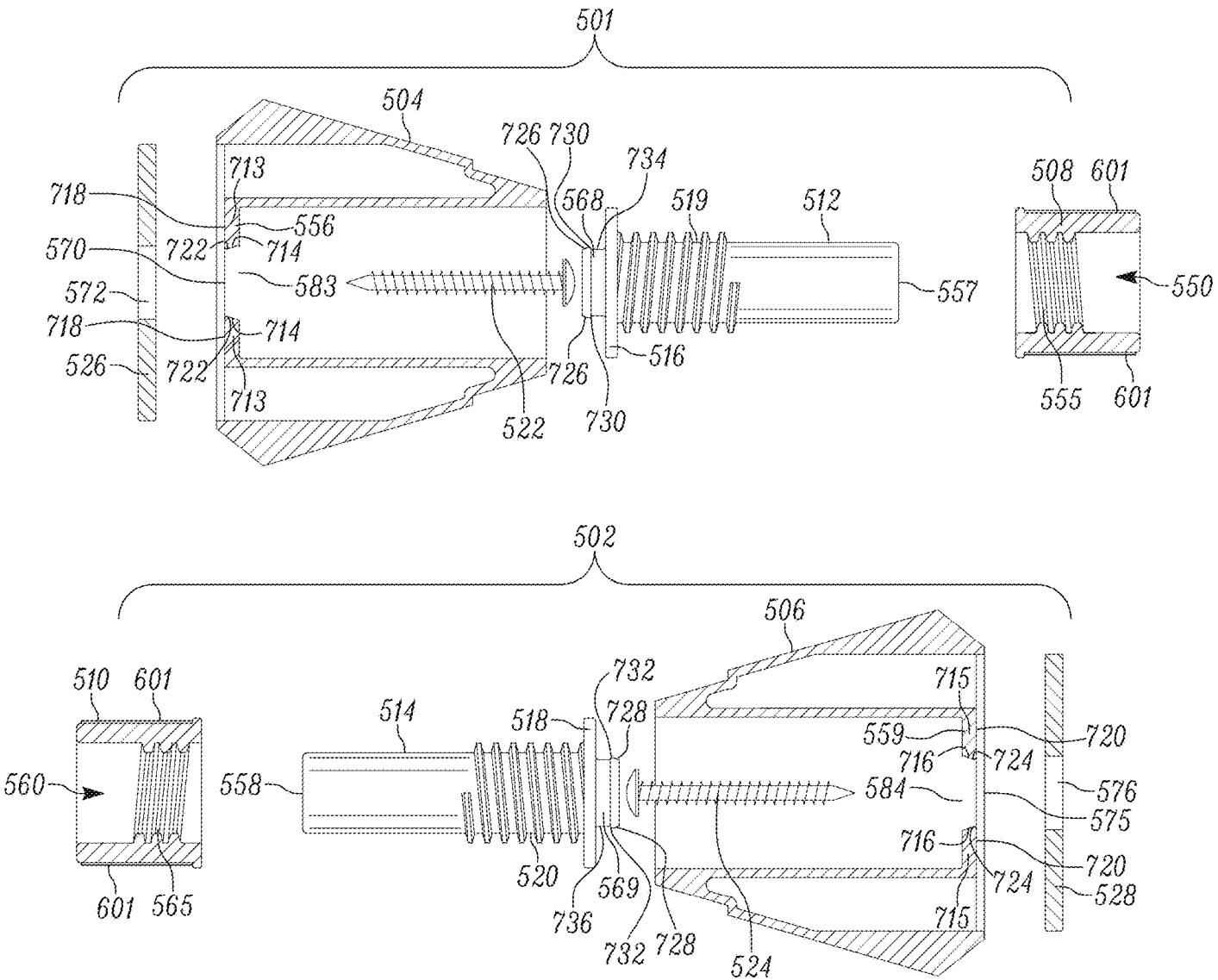
FIG. 29 is an exploded side elevation view of end cap assemblies for a dual-mount end cap system, wherein a cross section of the threaded inserts is taken.
Figure 32:
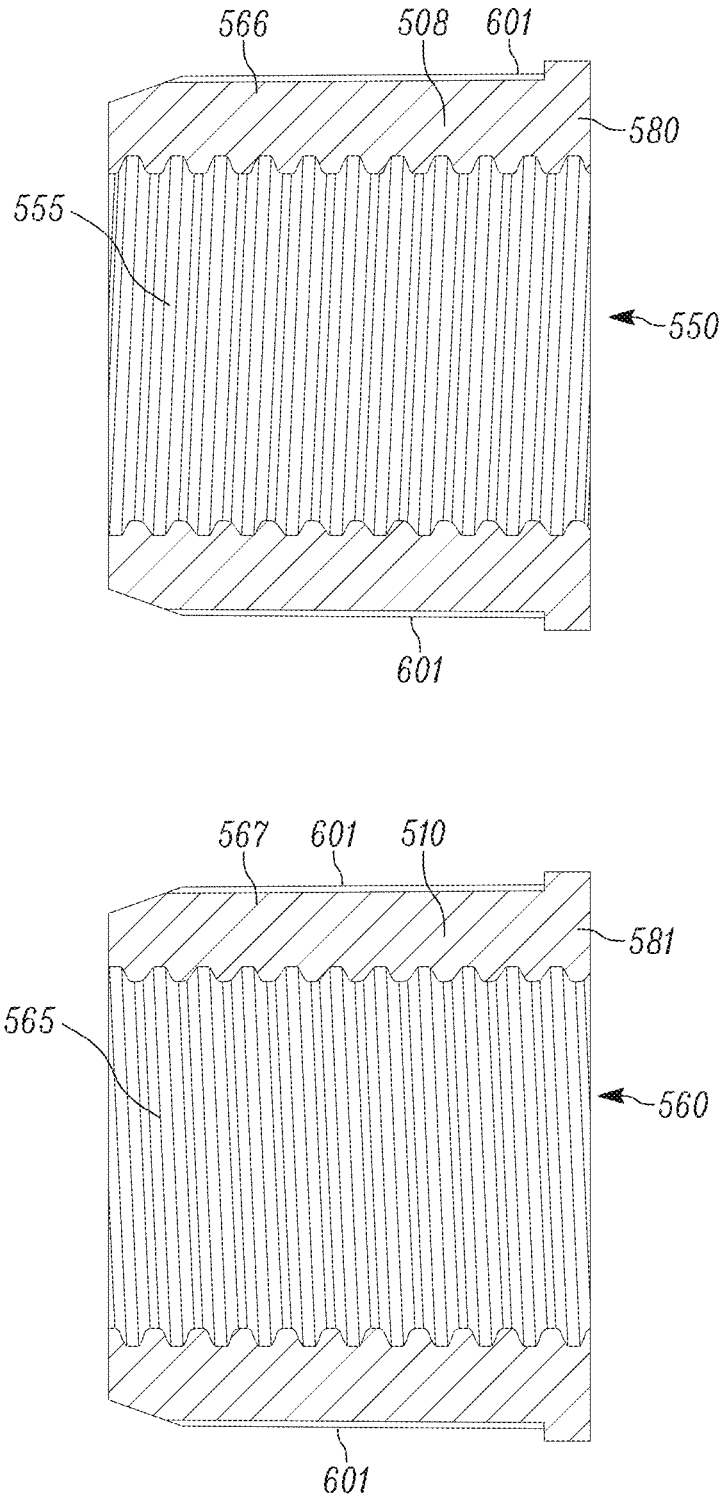
FIG. 32 is a cross-section view of threaded tube inserts for use in the end cap assemblies of FIG. 29.
Figure 33:
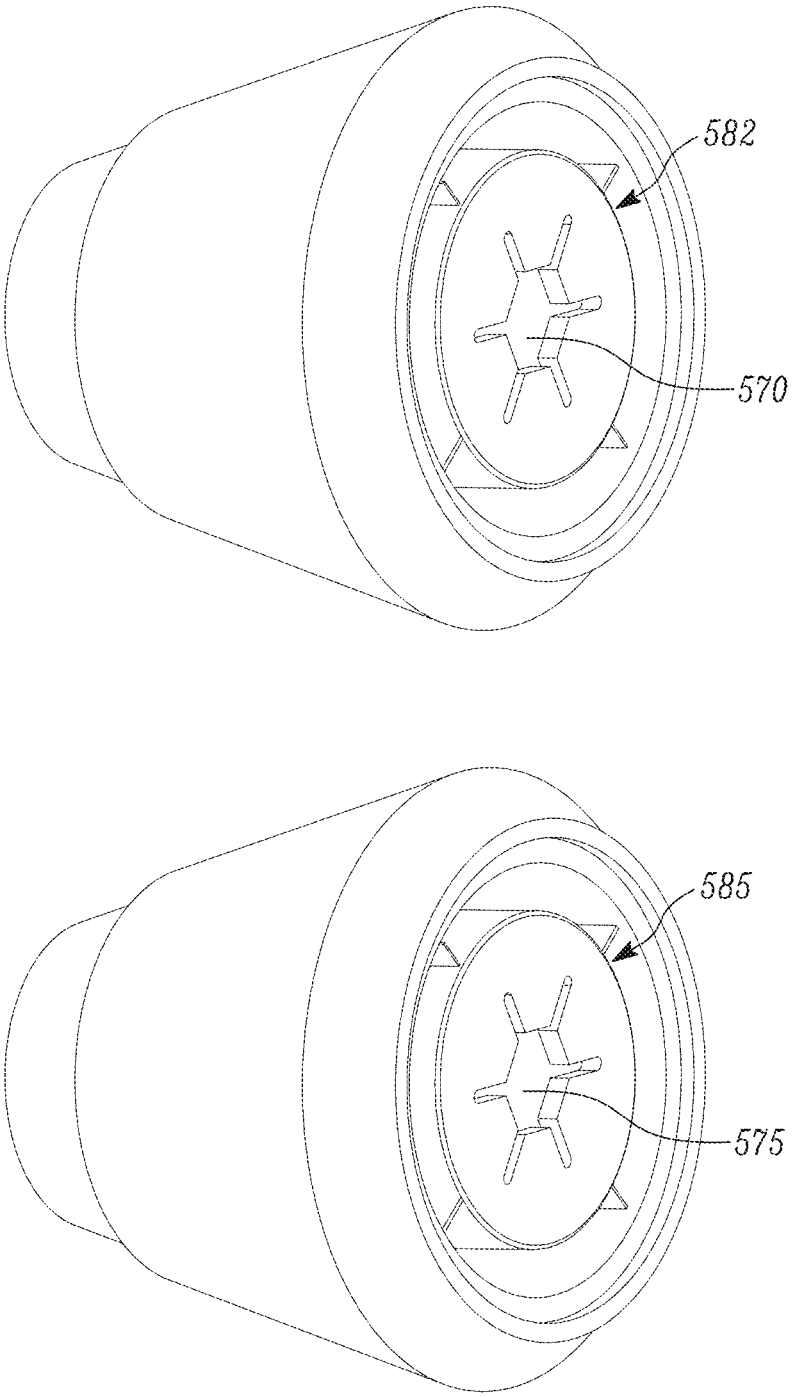
FIG. 33 is a perspective view of end caps for use in the end cap assemblies of FIG. 29.

As shown in FIGS. 28, 29 and 32, the left and right threaded tube inserts 508, 510 may have a generally cylindrical shape defined by the body portion 566, 567 and passages 550, 560. The passages 550, 560 can be partially or completely threaded with left- and right-hand threading 555, 565 along the length of the interior of the threaded inserts 508, 510, respectively. The left and right threaded tube inserts 508, 510 are sized to be received concentrically in a left end 94 of the outer tube 14 and a right end 96 of the inner tube 12, respectively. Each of the threaded tube inserts 508, 510 has an outer diameter that is sized to provide a friction fit with the internal surface of the engaged tube so that rotation of the tube rotates the respective insert 508, 510. One end of each tube insert 508, 510 includes a radially extending flange 580, 581 to engage the ends of the tubes 12, 14 to prevent the tube inserts 508, 510 from being completely inserted into the tubes 12, 14. There also may be additional inter-engagements formed between the tubes 12, 14 and the tube inserts 508, 510. For instance, the tubes 12, 14 may include detents 517, 523 that penetrate the tube inserts 508, 510 to lock the insert 508, 510 against rotational and translational movement.

Figure 30:
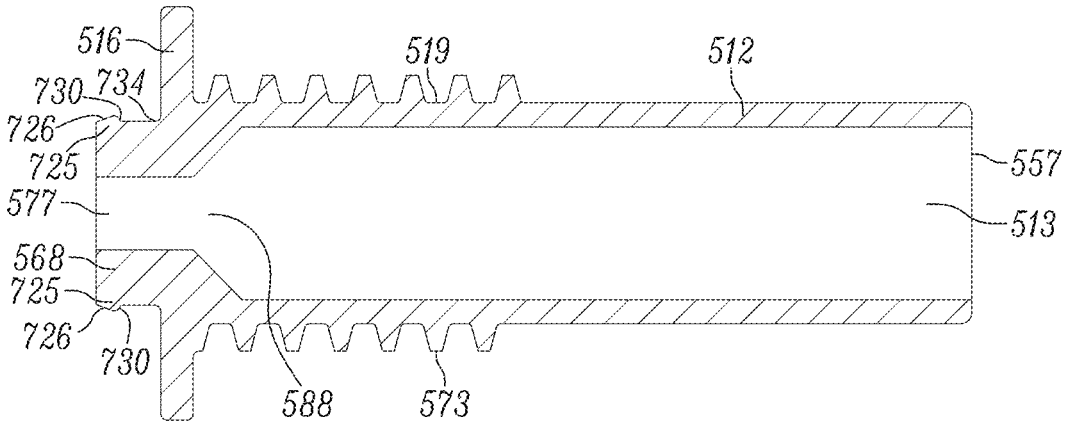
FIG. 30 is a cross-section view of rods for use in the end cap assemblies of FIG. 29.
Figure 30:
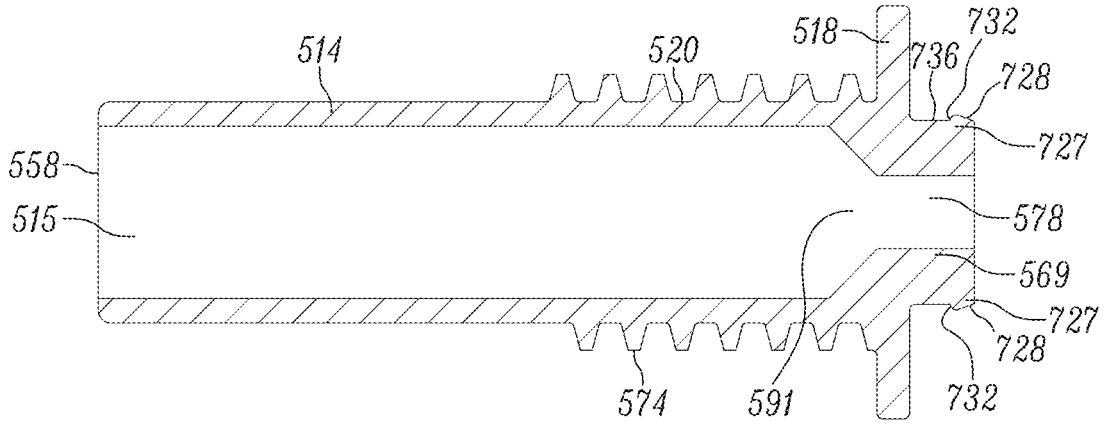
Figure 31:
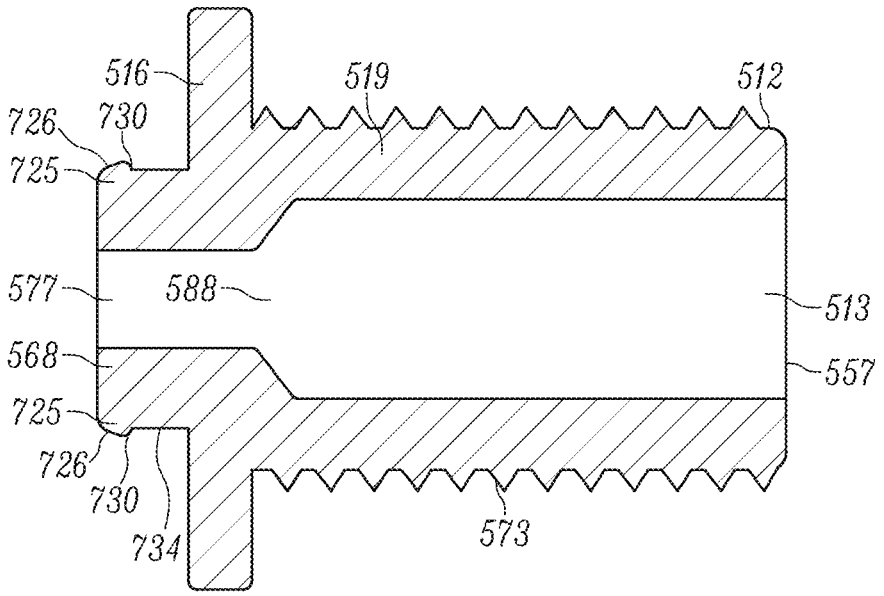
FIG. 31 is a cross-section view of a threaded cap insert for use in an end cap assembly of FIG. 29.

With reference to FIGS. 29 and 30, the cap inserts 512, 514 each include an inboard end 557, 558 and an outboard end or head 568, 569. Passages 513, 515 of the end cap inserts 512, 514 are configured to receive and guide the fasteners 522, 524. More specifically, each fastener 522, 524 may include a head 551, 552 for driving the fastener 522, 524 into a wall structure (see FIG. 28). The diameter of the passages 513, 515 may be just slightly larger than the head 551, 552 of the fasteners 522, 524. The cap inserts 512, 514 each include a radially extending flange 516, 518 inboard of the head 568, 569. The flanges 516, 518 can rest against an internal end structure or surface 556, 559 of the end caps 504, 506. Since the tubes 12, 14 have different outer diameters, the left threaded cap insert 512 may be scaled larger than the right threaded cap insert 514. This is the same for the left and right tube inserts 508, 510. In another embodiment, the left end cap insert 512 may be shortened so to, for example, include only the threaded portion (see FIG. 31).

The left and right threaded portions 519, 520 of the left and right threaded cap inserts 512, 514 include left-hand threads 573 and right-hand threads 574, respectively, which cooperate with the left- and right-hand threads 555, 565 of the left and right tube inserts 508, 510. Thus, the adjustable rod 10 only needs to be turned in one direction to tighten and loosen the end cap assemblies 501, 502. The flanges 580, 581 of the left and right threaded tube inserts 508, 510 (see FIG. 32) may engage the flanges 516, 518 of the left and right threaded cap inserts 512, 514, respectively In one embodiment, the following exemplary dimensions may be used. The inner tube 12 may have an inner diameter of approximately 0.875 inches, while the outer tube 14 may have an inner diameter of approximately 1 inch. The left threaded tube insert 508, sized to be received by the outer tube 14, may have an outer diameter of approximately 0.99 inches at the flange 580 and of approximately 0.95 inches at the portion received by the outer tube 14. The threaded tube insert 510, sized to be received by the inner tube 12, may have an outer diameter of approximately 0.89 inches at the flange 581, and a diameter of approximately 0.83 inches at the portion received in the tube 12. The passages 550, 560 of the threaded tube inserts 508, 510 may have a diameter of approximately 0.69 inches, and the threads 555, 565 may have a diameter of approximately 0.55 inches. The length of the threaded tube inserts 508, 510 may be approximately 0.85 inches.

The diameter of the left and right pads 526, 528 may be approximately 1.89 inches in diameter, wherein the concentric holes 572, 576 may have a diameter of approximately 0.5 inches. The pads 526, 528 may have a thickness of approximately 0.12 inches. The pads 526, 528, however, may have differing diameters.

With references to FIGS. 28 and 30, the heads 568, 569 of the cap inserts 512, 514 include holes 577, 578, respectively. The interior portions 513, 515 of the cap inserts 512, 514 extend from the inboard ends 557, 558 to the holes 577, 578. The fasteners 522, 524 are received in the inboard ends 557, 558 of the cap inserts 512, 514. A shaft portion 561, 562 of the fasteners 522, 524 can extend through the holes 577, 578 in the heads 568, 569 (see FIG. 28). The cross-section of the holes 577, 578 is preferably less than the cross-section of the interior portions 513, 515 so that the heads 551, 552 of the fasteners 522, 524 can bottom out at a transition 588, 591 between the interior portions 513, 515 and the holes 577, 578.

The holes 577, 578 may be oval, circular, triangular, or square. The head 568, 569 of the end caps 512, 514 may be circular, or square. The flanges 516, 518 may be hexagonal or circular.

With regard to FIGS. 27, 28, 29, 33 and 34, the left and right end caps 504 and 506 include holes 570 and 575, respectively. The holes 570 and 575 form an internally faced socket portion 583, 584 to receive the heads 568, 569 of the threaded cap inserts 512, 514. The heads 568, 569 may be externally faced to correspond to the internally faced socket portions 583, 584 so that the cap inserts 512, 514 and the end caps 504, 506 are locked against rotation relative to one another. The faces may be a single face or may take on any multiple face configuration, such as hexagonal, rectangular, triangular, etc.

Figure 36:
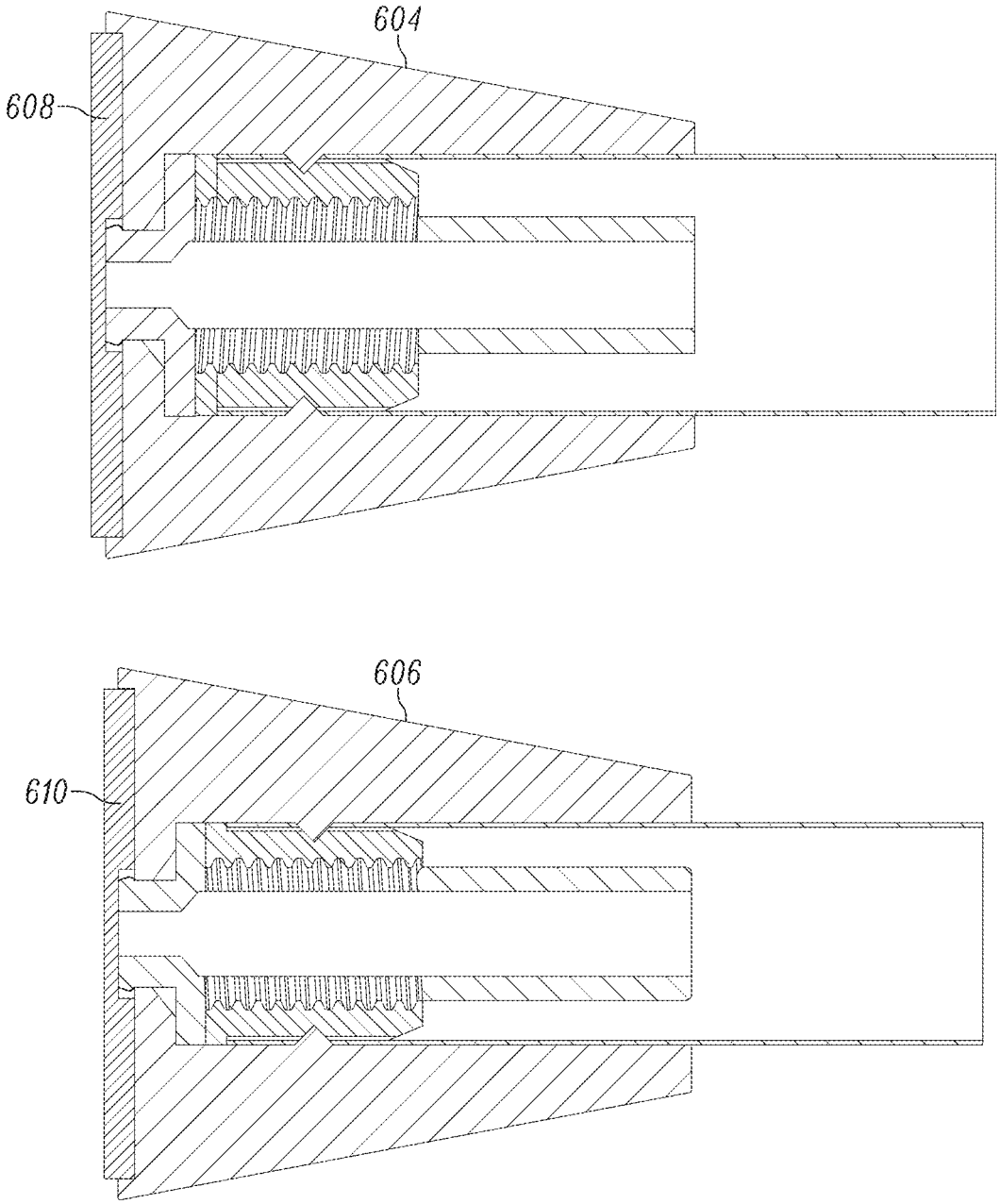
FIG. 36 is a cross-section view of end cap assemblies for a dual-mount end cap system.
Figure 37:
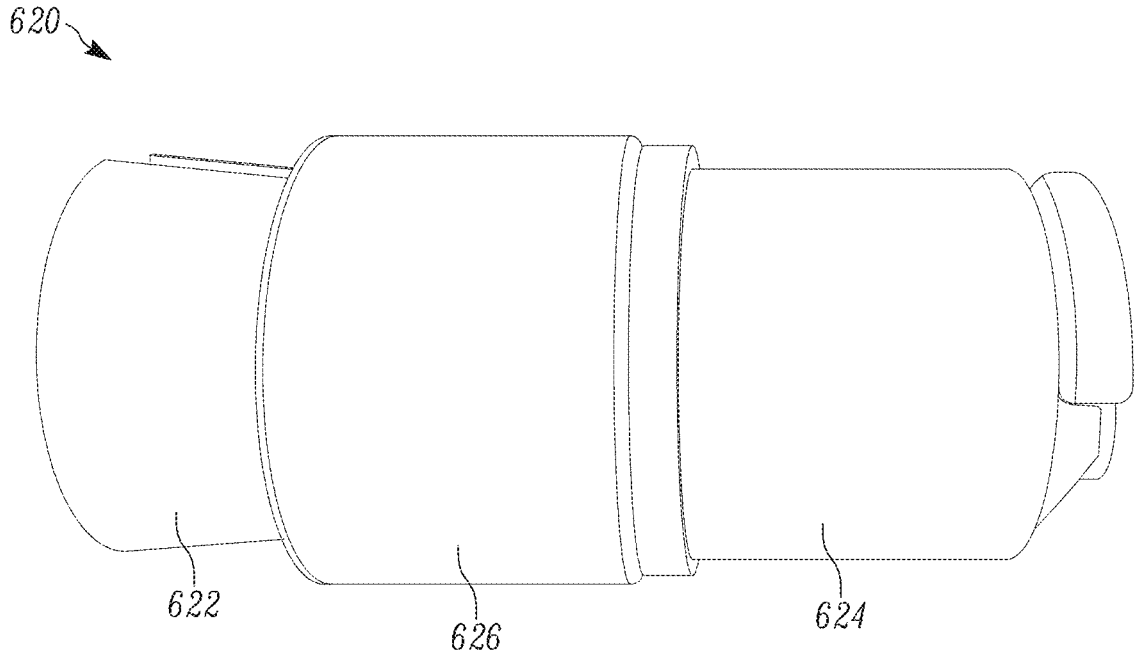
FIG. 37 is a side elevational view of an alternative lock assembly for a set of telescoping adjustable rods such as those of FIG. 1.
Figure 38:
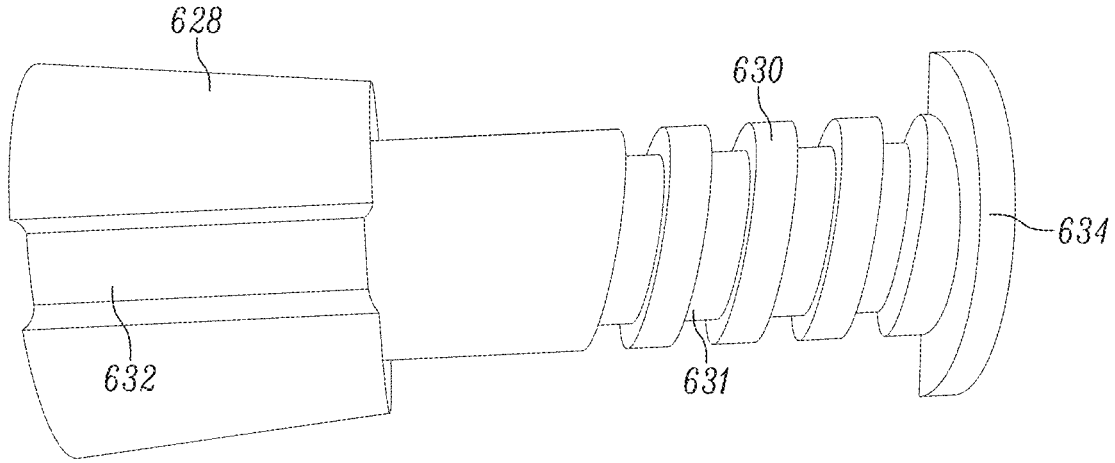
FIG. 38 is a side elevational view of a lock ramp for the lock assembly of FIG. 37.
Figure 39:
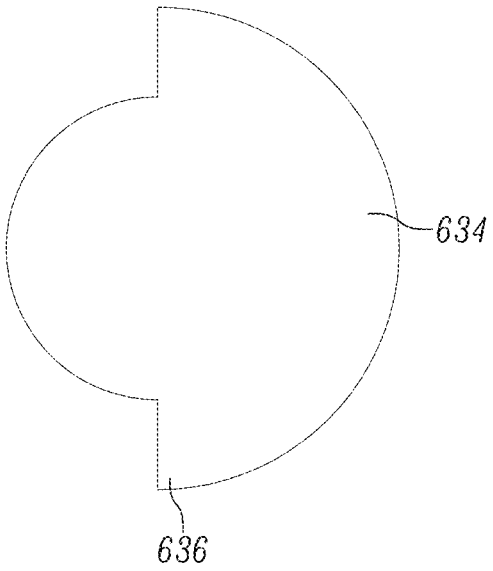
FIG. 39 is an end elevational view of a head portion of the lock ramp of FIG. 38.
Figure 40:
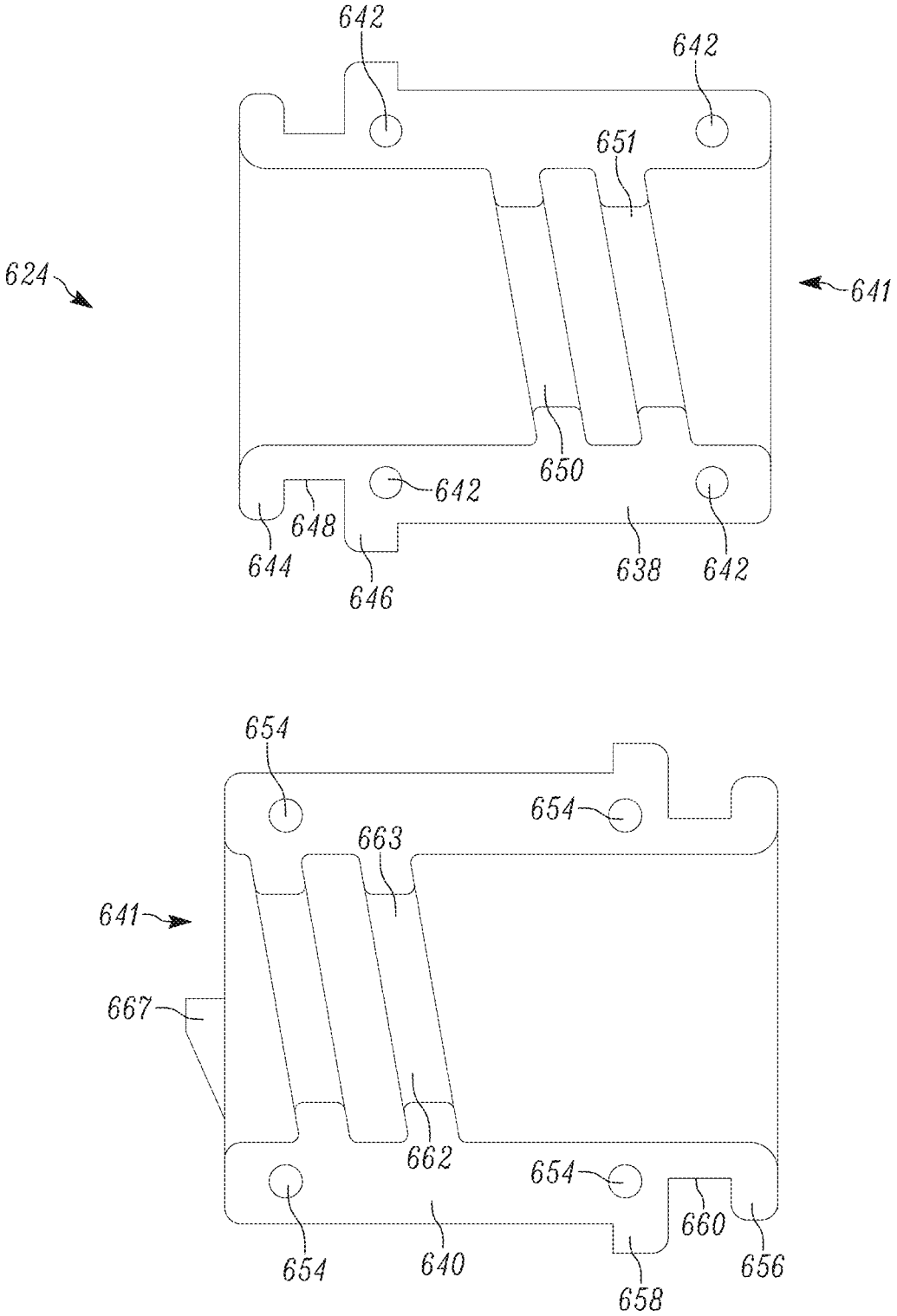
FIG. 40 is a side elevational view of a two-piece insert for the lock assembly of FIG. 37 with the two pieces separated.
Figure 41:
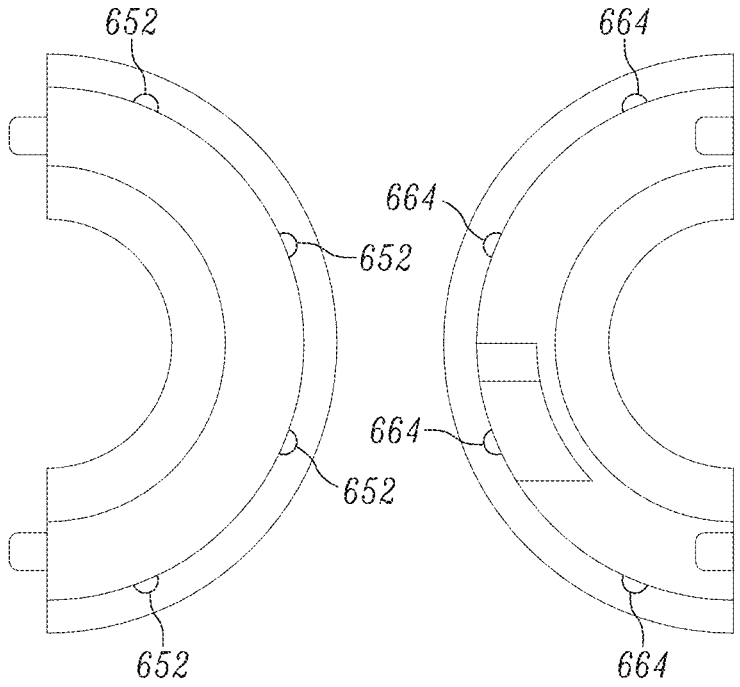
FIG. 41 is an end elevational view of the two-piece insert of FIG. 40 with the two pieces separated.
Figure 42:
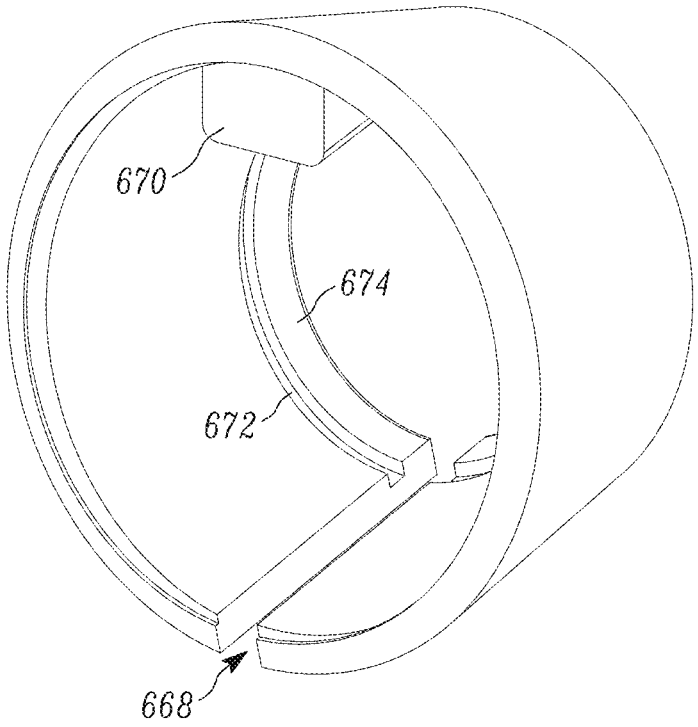
FIG. 42 is an end perspective view of a lock sleeve of the lock assembly of FIG. 37.

The shaft portion 561, 562 of the fasteners 522, 524 can extend through the holes 570, 575. The left and right end caps 504, 506 further include a circular recess 582, 585 for receiving the pads 526, 528. The pads 526, 528 can be retained in the recesses 582, 585 with a friction fit, adhesive or weld. The outer profile of the end caps 504, 506 may have a diamond shape. Alternatively, the outer profile can take on other shapes, such as a conical shape of end caps 604, 606 of FIG. 36. The end caps 504, 506 and end caps 604, 606 are interchangeable in the dual mount end cap system 500.

The fasteners 522, 524 can be separate from the threaded cap inserts 512, 514 or can be captivated in the left and right threaded cap inserts 512, 514 so that they are always contained in the system whether used or not. To captivate the fasteners 522, 524, one method might include a slight narrowing of the inboard end 557, 558 of the cap inserts 512, 514, such as after the fasteners 522, 524 have been placed therein, while leaving enough room for a tool to access the head 551, 552 of the fasteners 522, 524. Alternatively, the fasteners 522, 524 can be partially inserted into the head 568, 569 of the cap inserts 512, 514 or the end caps 504, 506 with a friction fit or a frangible connection or a series of tabs extending inward in the cap inserts to engage the fastener. The fasteners may be a screw, nail, molly-type or any other conventional fastener that includes a shaft and drive head.

Figure 34:
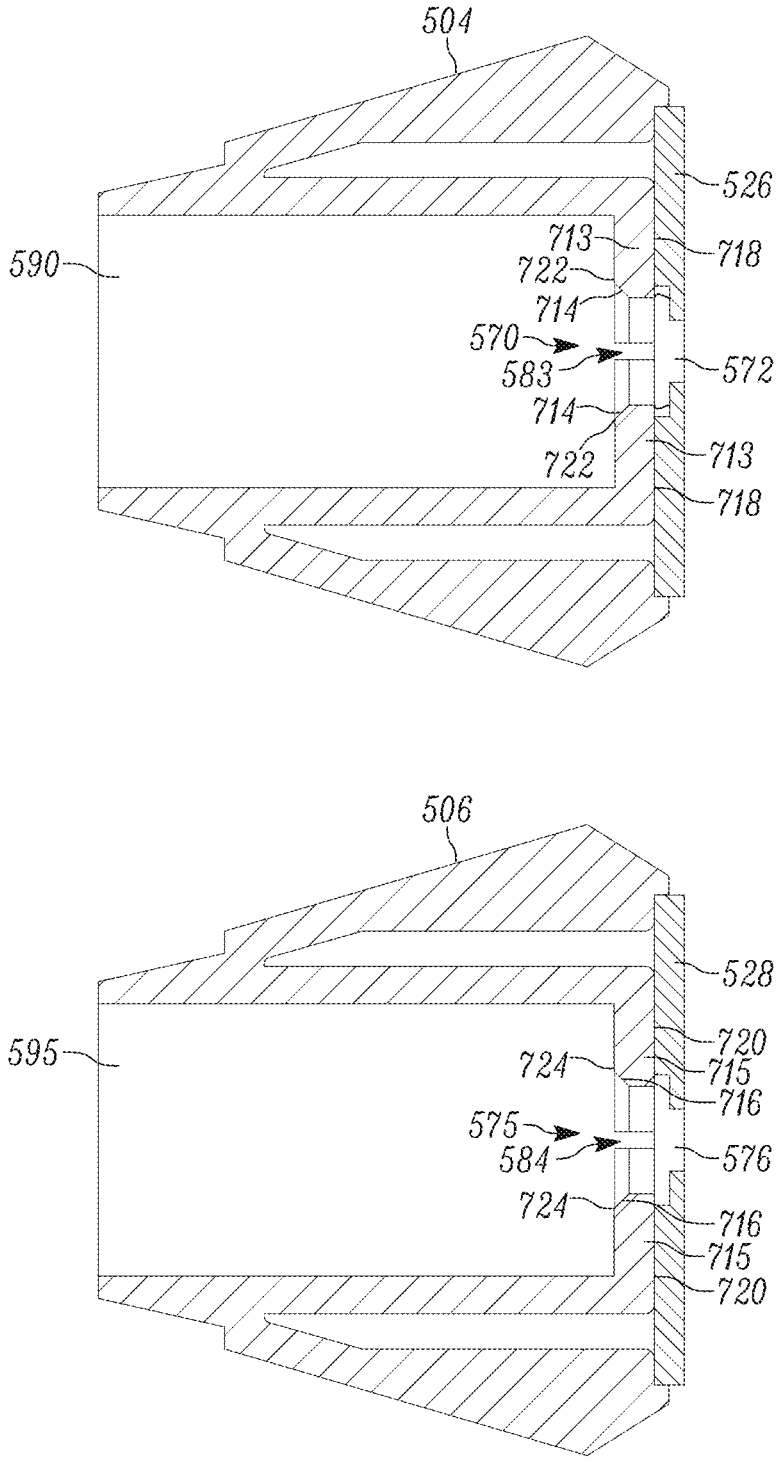
FIG. 34 is a cross-section view of the end caps of FIG. 33.
Figure 35:
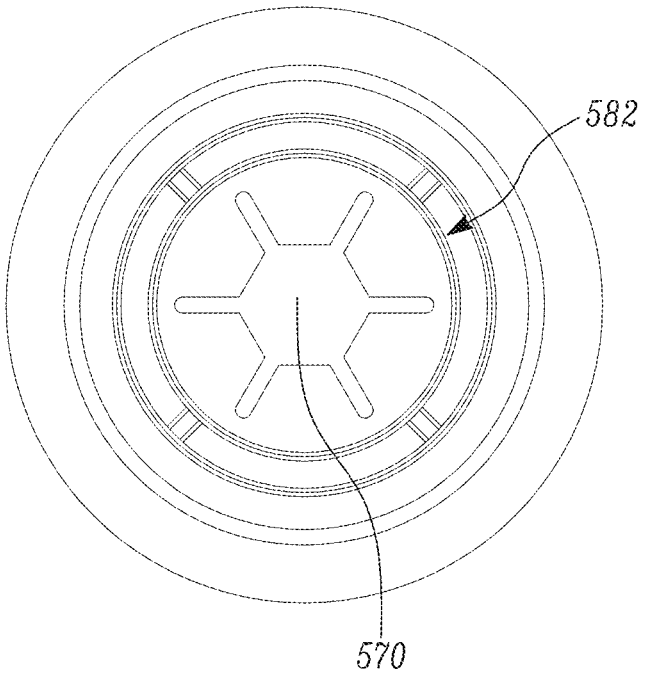
FIG. 35 is a front elevation view of the end caps of FIG. 33.
Figure 35:
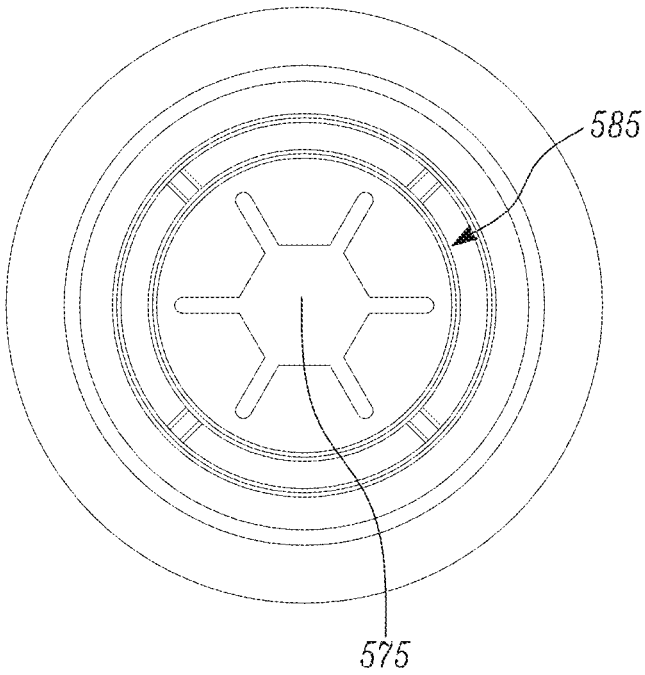

Regarding FIGS. 28, 29 and 34, the pads 526, 528 may include holes 572, 576. The holes 572, 576 are aligned with the holes 570, 575 of the left and right end caps 504, 506, respectively. The fasteners 522, 524 extend through the holes 572, 576. Alternatively, the pads 526, 528 may lack a hole for the fasteners (see, e.g., pads 608, 610 of FIG. 36). Instead, the fasteners may be capable of self-taping or creating the holes as the fasteners are inserted through the pads, such as turning of a screw type fastener. Further, the holes also may be pre-drilled using a conventional drill and drill bit or pre-punched.

The left and right end caps 504, 506 further include interior portions 590, 595. Interior portions 590, 595 are sized to receive the outer and inner tubes 14, 12. The interior surfaces of the interior portions 590, 595 contact the exterior surface of the outer and inner tubes 14, 12, respectively. More specifically, the interior portions 590, 595 are sized to fit over the outer surfaces of the outer and inner tubes 14, 12 with a slight friction fit so that there is minimal or no play between the two, but so that the tubes 12, 14 can be easily rotated in their respective end caps 506, 504 to operate the threaded engagement between the tube inserts 508, 510 and the cap inserts 512, 514. The interior surfaces 590, 595 can be made smooth in order to minimize friction between the end caps 504, 506 and the tubes 14, 12.

With respect to FIGS. 28-31 and 34, the left and right end caps 504, 506, include radial petals 713, 715. The radial petals 713, 715 include ramped surfaces 714, 716, flat surfaces 718, 720, and stepped surfaces 722, 724. The inboard ends 568, 569 of the end cap inserts 512, 514 include ridges 725 and 727 which include ramped surfaces 726, 728 and flat surfaces 730, 732, and neck portions 734, 736. When the user pushes the end cap inserts 512, 514 into the end caps 504, 506, the ramped surfaces 726, 728 of the inserts 512, 514 slide along the ramped surfaces 714, 716 of the radial petals 713, 715. When the ridges 725, 727 are through the holes 570, 575, the stepped surfaces 722, 724 of the radial petals 713, 715 contact the neck portions 734, 736 of the end cap inserts 512, 514, forming a snap fit interconnection, and thus, retain the end cap inserts 512, 514 in the end caps 504, 506 to prevent rotational motion of the inserts 512, 514 relative to the end caps 504, 506. The flat surfaces 730, 732 of the ridges 725, 727 come in contact with the flat surfaces 718, 720 of the radial petals 713, 715 to prevent the inserts 512, 514 from moving back through the holes 570, 575.

Figure 45:
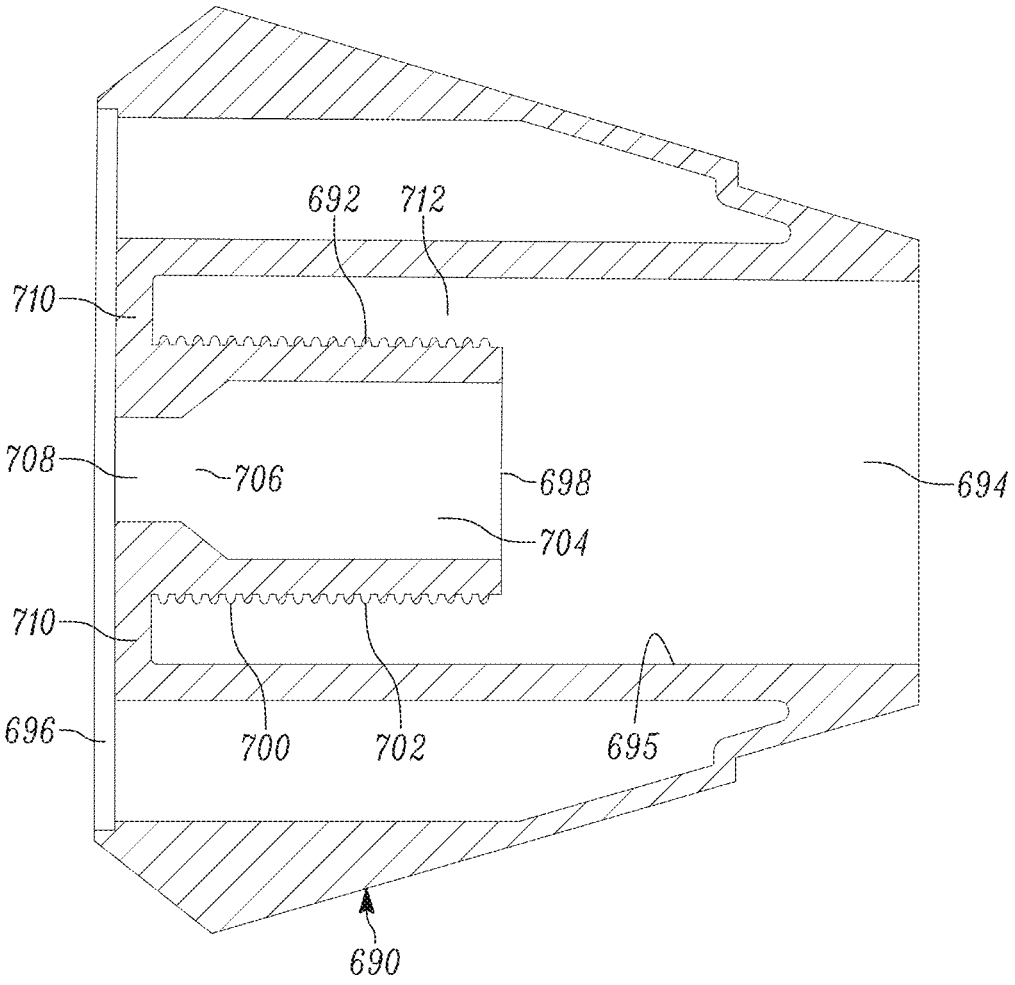
FIG. 45 is a cross-section view of an alternative end cap with a unitary insert.

With respect to FIG. 45, there is shown an alternative end cap 690 having an insert 692 fixed thereto as a single piece component. The end cap includes an interior portion 694, which houses the insert 692, an annular interior surface 695 and a circular recess 696 for receiving a pad, such as the pads 526, 528 in FIG. 29. The annular interior surface 695 has a diameter selected to receive the inner or outer tube 12, 14 with, preferably, a slight engaging fit that enables the tube to rotate therein but not wobble. The insert 692 includes an inboard end 698 for receiving a fastener, such as the fasteners 522, 524 in FIG. 29, a threaded portion 700, including threads 702, an interior portion 704 for guiding the fastener, a transition 706, a through hole 708 for receiving a shank of the fastener and aligned with a hole in the pad (see FIG. 29), and connections 710 wherein the insert 692 is connected to the end cap 690. The threads 702 are left handed if the end cap 690 is the left end cap, and right handed if the end cap 690 is the right end cap. The insert 692 and the interior surface 695 of the end cap 690 are sufficiently distanced such that there is an annular gap 712 between them. The annular gap 712 provides room to enable the tube inserts, such as tube inserts 508, 510, to thread on to the insert 692. The insert 692 can be molded as part of the end cap to be single, unitary component, or it can be glued or welded to the end cap to be a single, unitary component. Since the insert 692 is a unitary component with the end cap, there is no relative rotation between the insert 692 and the end cap. The other features of the end caps discussed above can used with the end cap 692.

With reference to FIGS. 37-44, there is illustrated an alternative lock assembly 620. The lock assembly 620 provides a stop system to prevent the lock assembly 620 from becoming stuck in the fully unlocked position. The lock assembly 620 may be used with any of the rod assemblies disclosed herein and any other telescopic rod assemblies.

The lock assembly 620 includes a lock ramp 622, an inner tube insert 624, and a lock sleeve 626. The lock ramp 622 and the inner tube insert 624 may be molded from any rigid material, including a rigid plastic material. The lock sleeve 626 also may be molded from any rigid material, including plastic, but must be flexible enough to expand as it moves along the lock ramp 622 and provide a sufficient frictional engagement with an inner surface of the outer tube to lock the tubes against relative movement.

The lock ramp 622 includes a frusto-conical wedge portion 628 at one end and a threaded portion 630 with a right-hand thread 631. The wedge portion 628 includes a groove 632 extending longitudinally along the length of the wedge portion 628. A head 634 is at the other end of the lock ramp 622 and includes a stop 636 (see FIG. 39) at the other end. The longitudinal groove 632 guides longitudinal movement of the lock sleeve 626 along the wedge portion 628. The stop 636 prevents rotation of the insert 624 relative to the threaded portion 630 of the lock ramp 622 so that the insert 624 does not overtighten against the head 634.

The inner tube insert 624 has a generally hollow cylindrical shape and includes a male component 638 and a female component 640. When the male component 638 and the female component 640 are mated to form the insert 624, the components 638, 640 from passage 641 through the insert 624. The insert 624 fits with a friction fit in the left end of the inner tube 12 (see, e.g., FIG. 15). The insert 624 can further be captivated in the inner tube 12 by one or more notches or detents formed in the wall of the inner tube that penetrate the outer surface of the insert 624, like the notches 517 in FIG. 28. The engagement between the insert 624 and the inner tube 12 prevents rotation of the insert 624 relative to the tube 12.

The male component 638 includes protrusions 642, a first circumferential flange 644, a second circumferential flange 646, an annular groove 648 formed between the first circumferential flange 644 and the second circumferential flange 646, a threaded portion 650 having left hand threads 651, and exterior longitudinally extending ribs 652, which provide a better friction fit between the insert 624 and the inner tube 12. The female component 640 includes recesses 654, a first circumferential flange 656, a second circumferential flange 658, an annular groove 660, a threaded portion 662, having left hand threads 663, exterior longitudinally extending ribs 664, which provide a friction fit between the insert 624 and the inner tube 12, and a stop 667, which engages the stop 636 of the lock ramp 622 upon unlocking the lock mechanism 620.

The recesses 654 of the female component 640 receive the protrusions 642 of the male component 638, such that the components 638, 640 may be combined to form the insert 624. The protrusions 642 may have a friction fit in the recesses 654 or may be glued or welded in the recesses. While four protrusions and recesses are shown, it should be understood that there may be more or less than four of each.

The second circumferential flanges 646, 658 combine to form a single annular flange that extend about a perimeter of one end of the insert 624 for engaging an end of the inner tube 12, such as the left end 246 of the inner tube 12 (see FIG. 15) to prevent complete insertion therein. The left hand threads 651, 663 combine to form a single thread, such that turning the insert 624 toward the user locks the assembly 620 and turning the insert 624 away from the user unlocks the assembly 620. The thread 631 of the threaded portion 630 of the lock ramp 622 meshes with the threads 651, 663 of the insert 624. The first circumferential flanges 644, 656 combine to form a single annular flange. The lock sleeve 626 includes an annular groove 672 that receives the annular flange formed by the first circumferential flanges 644, 656 of the insert 624. The lock sleeve 626 includes an interior flange 674 which in received in a single annular groove formed by the annular grooves 648, 660 of the insert 624, thus connecting the insert 624 and the lock sleeve 626. As the threaded portion 630 of the lock ramp 622 is turned into the insert 624, the lock sleeve 626 expands to lock the tubes 12, 14 against movement relative to one another. The expansion of the lock sleeve 626 is not to an extent that would cause the attachment between the lock sleeve 626 and the insert 624 to become disconnected.

The lock sleeve 626 has an elongated slot 668 along its entire axial length to form a split configuration. This enables the lock sleeve 626 to be expanded from a first state that allows relative movement of the tubes 12, 14 to a second state to lock the tubes 12, 14 against relative movement. The lock sleeve 626 includes a longitudinally extending rib 670 on its interior that is offset 180 degrees from the slot 668. The lock sleeve 626 receives the wedge portion 628 of the lock ramp 622 with the rib 670 in the groove 632 of the lock ramp 622. Operation of the alternative lock assembly 620 is the same as that described above for the lock assembly of FIG. 21.

Figure 43:
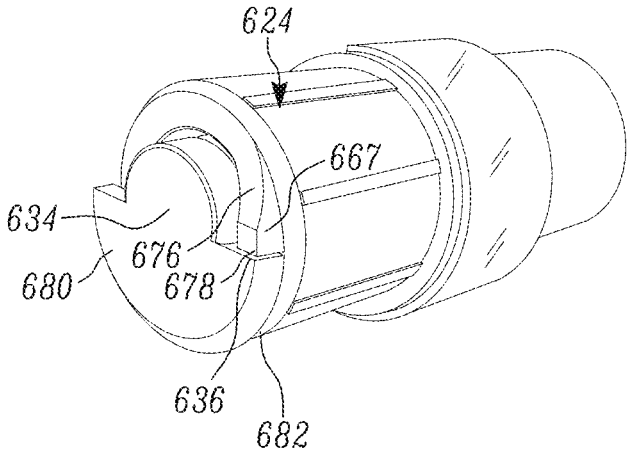
FIG. 43 is an end perspective view of the lock assembly of FIG. 37.
Figure 44:
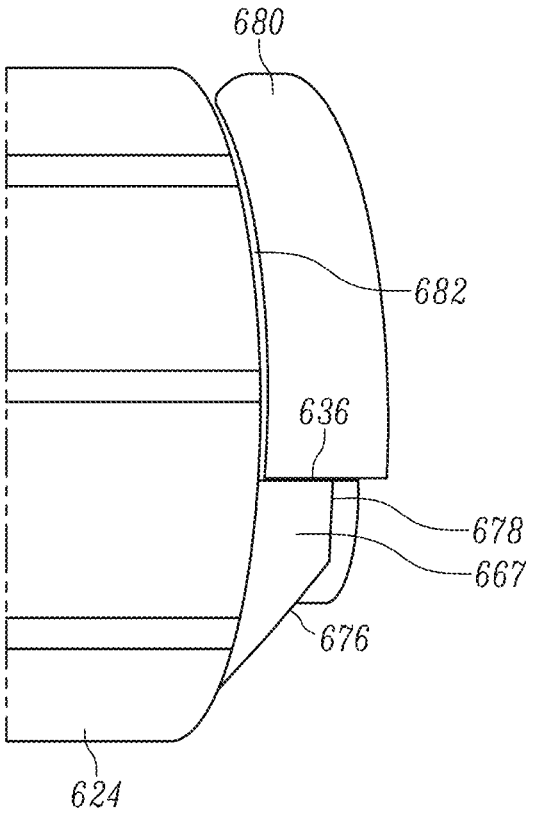
FIG. 44 is a side perspective view of a stop system of the lock assembly of FIG. 37.

With reference to FIGS. 43 and 44, the stop 667 is on the portion of the insert 624 facing the head 634 of the lock ramp 622. The stop 667 is configured as a ramp with a stepped surface 678 and a ramped surface 676. The stop 636 is on the head 634 of the lock ramp 622 at the end of the threaded portion 630. More specifically, the stop 636 is formed by a radial flange 680 about a portion of the head 634. The radial flange 680 may extend about 180 degrees around the head 634. The insert 624 and the threaded portion 630 of the lock ramp 622 reside in the inner tube 12, and when locking the tubes 12, 14, the stop 667 of the insert disengages the stop 636 of the lock ramp 622. If the locking mechanism 620 is in the fully unlocked position, the radial flange 680 may slide along the ramped surface 676 during the first and/or additional twists of the threaded portion 630 in the locking direction so that the flange 680 does not get caught on the stop 667 as the stop 636 rotates away from the stop 667.

When the user loosens the adjustable rod 10 by rotating the inner tube 12 counterclockwise, thus operating the left-hand threads 651, 663 of the insert 624, the stop 667 of the insert 624 moves toward the head 634 of the lock ramp 622. The insert 624 rotates until the stop 667 engages the stop 636 of the head 634. The stops 636, 667 are rigid and prohibit further rotation of the insert 624 and the lock ramp 622 relative to one another. The relative circumferential location of the stop 636 and the lock ramp 622 may be positioned to leave a small gap 682 between the insert 624 and the head 634 when the insert 624 is rotated to its fully unlocked position. This ensures that the insert 624 and head 634 will not become stuck together and resist or even prevent rotation in the locking direction.

The following describes an exemplary method of installation. The user will be provided with the adjustable tubes 12, 14, the end cap assemblies 501, 502 attached to the ends of the tubes 12, 14, and the fasteners 522, 524. These components may be packaged together as a kit. The kit may also include tools, such as a measuring device and a driver for the fastener 522, 524 to help install the rod. To install the rod, the user first identifies the location for the end cap assemblies 501, 502. This can be done by measuring the height from the floor and the distance from an adjacent wall or other structure. Once the locations are identified, the user then mounts the end cap assemblies 501, 502. If the end cap assemblies 501, 502 are pre-mounted to the tubes 12, 14, they must be detached by unthreading the end cap inserts 512, 514 from the tube inserts 508, 510.

Next, the user aligns the hole 577, 578 in the head 568, 569 of the cap inserts 512, 514, and the opening 570, 575 in the end cap 504, 506 and the pad 526, 528 with the identified mounting location. Then, the shaft of the fastener 522, 524 is inserted through these aligned holes and into the mounting surface. Alternatively, the user can extend the fasteners 522, 524 through the aligned holes of the head hole 577, 578 in the head 568, 569 of the cap inserts 512, 514, and the opening 570, 575 in the end cap 504, 506 and the pad 526, 528. Then, the user aligns the tip of fastener with the mounting location.

The user can adjust the depth of insertion of the fastener 522, 524 into the mounting surface to achieve the desired tightness of the end caps 504, 506 on the mounting surface. Depending on the type of fastener, a tool can be used with the head of the fastener to insert the fastener into the mounting structure. For instance, a screw driver can be used with a screw or a punch can be used with a hammer for a nail. Also, if the pad is not pre-formed with a hole, then a hole may be added before aligning the end cap assembly with the location on the mounting surface.

Next, the inner tube 12 and the outer tube 14 are extended in opposite directions toward the respective end cap assemblies 501, 502 until the threaded inserts 508, 510 in the inner and outer tubes 12, 14 engage the threaded rods 512, 514 in the end caps 504, 506. The threaded tube inserts 508, 510 are sufficiently threaded with the threaded cap inserts 512, 514 by rotating the tubes 12, 14 in the same direction and toward the user until the inner and outer tubes 12, 14 are sufficiently seated in the end caps 504, 506. While not necessary when using the pre-mounted end caps, the user may lock the tubes 12, 14 against longitudinal movement relative to each other by engaging the locking mechanisms discussed above.

Finally, one rotates both the inner and outer tubes 12, 14 in the same direction and toward the user (i.e., clockwise looking down the inner tube 12 at the right end cap 506) to operate the left hand threads 555, 573 of the left threaded tube insert 508 and left threaded cap insert 512 and the right hand threads 565, 574 of the right threaded tube insert 510 and the right threaded cap insert 514. This will cause the inner and outer tubes 12, 14 to apply pressure to the end caps 504, 506 to tighten the end caps 504, 506 on the mounting surfaces and further secure the extendable rod 10. Sufficient pressure of the end caps 504, 506 against the mounting surface can be achieved to secure the extendable rod 10 without the use of the fasteners 522, 524 such that the fasteners are optional.

In some embodiments, the fasteners 522, 524 will be separate from the threaded cap inserts 512, 514. In other embodiments, the fasteners 522, 524 may be pre-attached (such as at the factory) to their respective end cap to simplify installation. The inboard ends 557, 558 of the threaded cap inserts 512, 514, may have one or more protrusions in the passage 513, 515 to prevent the fastener 522, 524 from being removed from the passage 513, 515 of the threaded cap insert 512, 514. In further embodiments, the inboard ends 557, 558 may have a frangible connection with the fastener 522, 524, such that when contacted with enough force, the connection between the fastener 522, 524 and the inboard end 557, 558 breaks, allowing the user to push the fastener 522, 524 through the through holes 577, 578 and the opening 570, 575. Also, in additional embodiments, the holes 577, 578 or openings 570, 575 of the end cap assembly 501, 502 may be initially smaller in diameter than the fastener (e.g., the screw or nail shaft) so that the fastener can be preset at least partially in one or more of the holes 577, 578 and the openings 570, 575 if desired. For instance, a screw could be partially threaded into the holes 577, 578. In even further embodiments, the fastener 522, 524 may be a molly-type fastener installed in the mounting surface.

When using the locking mechanism 620, the user holds the outer tube 14 stationary and rotates the inner tube 12 clockwise. This causes the threaded engagement between the lock ramp 622 and the insert 624 to draw the wedge portion 628 toward the insert 624 which, in turn, causes the wedge portion 628 to push into the lock sleeve 626 guided by the groove 632 and rib 670 and expand the lock sleeve 626. Once expanded sufficiently, the lock sleeve 626 becomes wedged tightly between the wedge portion 628 and the inner surface 242 of the outer tube 14 (see, e.g., FIG. 15) causing the inner and outer tubes 12, 14 to be locked against relative movement.

Next, one rotates both the inner and outer tubes 12, 14 in the same direction toward the one's body (i.e., clockwise looking at the right end cap 506). This will cause the end caps 504, 506 to move away from one another to provide the appropriate force on the mounting walls to secure the adjustable rod 10. The tubes 12, 14 can be rotated in the opposite direction to release the pressure to remove the adjustable rod 10, such as for repositioning or removal. Rotation in the opposite direction is limited by the stop 636 on the head 634 and the lock ramp 622 engaging another to prevent the insert 624 form becoming jammed on the head 634.

It will be understood that various changes in the details, materials, and arrangements of parts and components which have been herein described and illustrated in order to explain the nature of the systems and operations may be made by those skilled in the art within the principle and scope of the subject matter expressed in the appended claims. Furthermore, while various features have been described in connection with particular embodiments, it will be appreciated that features described for one embodiment also may be incorporated with the other described embodiments.

What is claimed is:

1. An end cap for a rod comprising:

a single piece body for engaging a surface, the single piece body defining a hole and having an internal thread for use in adjusting the single piece body relative to a rod, a first wall defining a first space for receiving a rod, and a second wall being radially spaced outward of the first wall to define a second space between overlapping portions of the first wall and the second wall radially outward of the first space; and a fastener sized to extend through the hole transverse to the internal thread to be used to attach the single piece body to a support structure.

2. An end cap of claim 1 wherein the single piece body comprises a guide wall that encircles at least a part of fastener to introduce the fastener to the hole of the single piece body.

3. An end cap of claim 1 wherein the fastener is at least one of a screw, nail or molly-type fastener.

4. An end cap of claim 1 further comprising a pad associated with the single piece body to engage a mounting surface.

5. An end cap of claim 4 wherein the pad defines an aperture for the fastener.

6. An end cap of claim 1 wherein the first wall is entirely confined by the second wall.

7. An end cap of claim 1 wherein at least one of the first wall and the second wall includes the internal thread.

8. An adjustable rod comprising:

an outer rod;

an inner rod telescopically received by the outer rod;

an engagement assembly coupling the inner rod and the outer rod to one another and allowing the inner rod and outer rod to move telescopically relative to one another, the engagement assembly including a helical engagement between the outer rod and the inner rod, the helical engagement having a first anchor in the outer rod and a second anchor in the inner rod;

a first end cap defining a first socket receiving one end of the outer rod, the first end cap including a first non-threaded inner side surface engaging the outer rod and a first bottom wall defining a first fastener hole within the first socket;

a second end cap defining a second socket receiving one end of the inner rod, the second end cap including a second non-threaded inner surface engaging the inner rod and a second bottom wall defining a second fastener hole within the second socket;

a fastener for each of the first fastener hole and the second fastener hole.

9. The adjustable rod of claim 8 wherein the first end cap defines a first space that surrounds at least in part the first socket of the first end cap.

10. The adjustable rod of claim 9 wherein the second end cap defines a second space that surrounds at least in part the second socket of the second end cap.

* * * * *